US007556399B1

(12) United States Patent
Bailey

(10) Patent No.: US 7,556,399 B1
(45) Date of Patent: Jul. 7, 2009

(54) LIGHT REFLECTOR ASSEMBLY HAVING OPPOSED REFLECTOR SECTIONS

(76) Inventor: Michael L. Bailey, 1491 Spruce Dr., Smyrna, GA (US) 30080

( * ) Notice: Subject to any disclaimer, the term of this patent is extended or adjusted under 35 U.S.C. 154(b) by 61 days.

(21) Appl. No.: 11/627,147

(22) Filed: Jan. 25, 2007

Related U.S. Application Data

(60) Provisional application No. 60/762,064, filed on Jan. 25, 2006.

(51) Int. Cl.
*F21V 7/09* (2006.01)
*F21V 1/10* (2006.01)

(52) U.S. Cl. ..... 362/241; 362/247; 362/298; 362/347; 362/349; 362/225

(58) Field of Classification Search ..... 362/147, 362/225, 240, 241, 247, 252, 298, 347, 349; D26/75, 80; 40/558, 572
See application file for complete search history.

(56) References Cited

U.S. PATENT DOCUMENTS

| | | | | | |
|---|---|---|---|---|---|
| 743,687 | A | | 11/1903 | Burnham | |
| 767,875 | A | * | 8/1904 | D'Olier, Jr. | 362/241 |
| 943,246 | A | * | 12/1909 | Goehst | 40/563 |
| 947,127 | A | * | 1/1910 | Roberts | 362/294 |
| 1,203,576 | A | * | 11/1916 | Broadhead | 362/241 |
| 1,359,341 | A | * | 11/1920 | Dicus | 40/572 |
| 1,782,551 | A | * | 11/1930 | Sullivan | 362/298 |
| 2,284,194 | A | | 5/1942 | Gangbin | |
| 2,305,722 | A | * | 12/1942 | Livers | 362/225 |
| 2,323,059 | A | * | 6/1943 | Land | 362/293 |
| 3,096,030 | A | | 7/1963 | Harling | |
| 3,557,359 | A | | 1/1971 | Meyer | |
| 4,054,793 | A | | 10/1977 | Shemitz | |
| 4,300,185 | A | | 11/1981 | Wakamatsu | |
| 4,536,830 | A | | 8/1985 | Wisniewski | |
| 4,564,892 | A | | 1/1986 | Oram | |
| 4,748,543 | A | | 5/1988 | Swarens | |
| 4,947,292 | A | | 8/1990 | Vlah | |
| 5,097,401 | A | | 3/1992 | Eppler | |
| 5,272,608 | A | | 12/1993 | Engle | |
| 5,539,623 | A | * | 7/1996 | Gurz et al. | 362/349 |
| 5,560,699 | A | | 10/1996 | Davenport et al. | |
| 5,709,460 | A | * | 1/1998 | Lester | 362/147 |

(Continued)

FOREIGN PATENT DOCUMENTS

GB 2143067 A * 1/1985

*Primary Examiner*—Ismael Negron
(74) *Attorney, Agent, or Firm*—Smith, Gambrell & Russell LLP

(57) ABSTRACT

A light reflector assembly for providing selective direct and indirect lighting includes a first section reflecting light from a first light source in a first direction and a second section reflecting light from a second light source in a second direction. The first section and the second section are connected by a central section or by end caps. The first section substantially surrounds a first light source to provide direct lighting for the user, and the second section substantially surrounds a second light source to provide indirect lighting for the user, either at the same time or independently, as desired by the user. The position of the first and second section may be adjusted to control the light dispersed by the light sources as desired by the user, and may further include secondary reflectors or diffusers for adjustment of the light.

19 Claims, 44 Drawing Sheets

U.S. PATENT DOCUMENTS

| | | | | |
|---|---|---|---|---|
| 6,379,026 | B1 | 4/2002 | Petrick | |
| 6,398,384 | B2 * | 6/2002 | Siminovitch et al. | 362/225 |
| 2002/0003699 | A1 * | 1/2002 | Shemitz et al. | 362/225 |
| 2004/0095771 | A1 | 5/2004 | McDonald | |
| 2005/0047138 | A1 | 3/2005 | Rochna | |

* cited by examiner

Fig. 31a
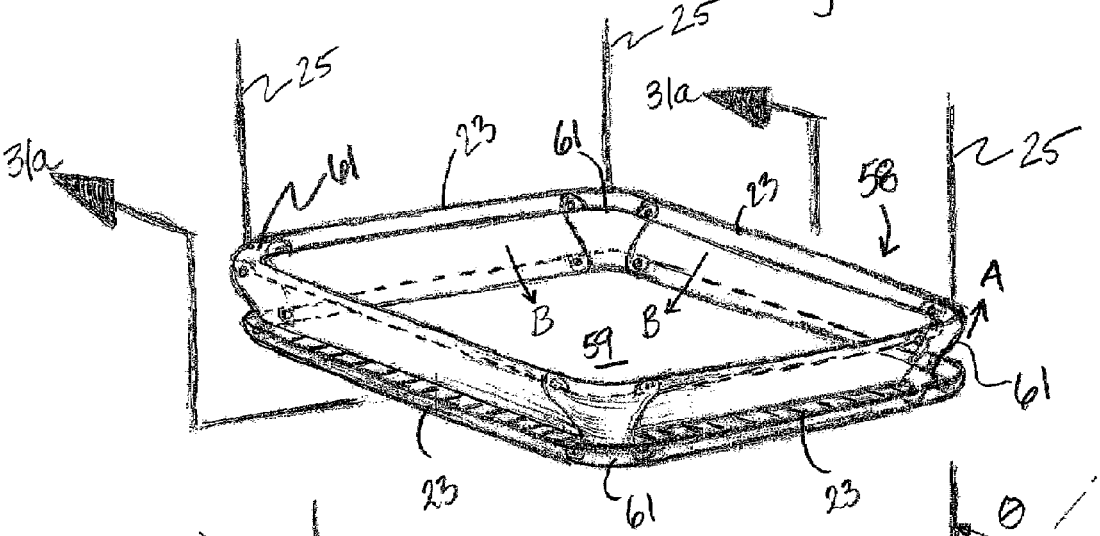
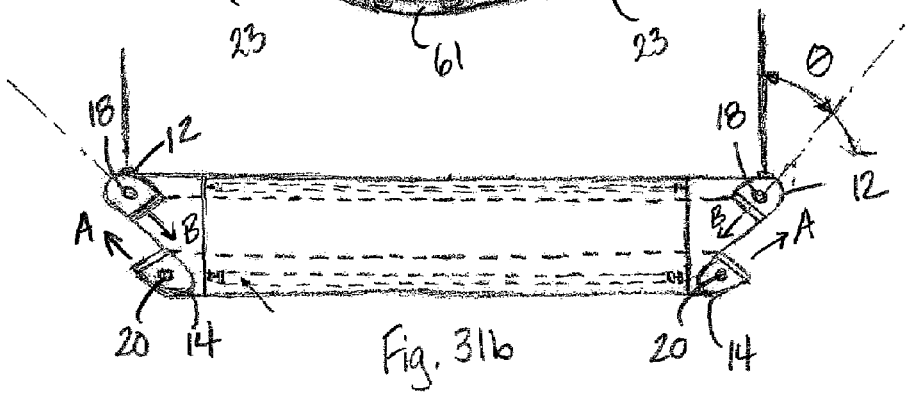
Fig. 31b

LIGHT REFLECTOR ASSEMBLY HAVING OPPOSED REFLECTOR SECTIONS

CROSS-REFERENCE TO RELATED APPLICATIONS

This non-provisional patent application claims priority from provisional patent application No. 60/762,064, filed on Jan. 25, 2006, which is herein incorporated by reference.

BACKGROUND OF THE INVENTION

Various lights and light reflector designs are known to maximize the illumination or projection system output of a lamp thereby increasing light source efficiency. Commonly used designs are parabolic or elliptical reflectors that resemble small satellite dishes in their parabolic geometry, with a small hole either in the center, or offset a few degrees, to focus and project a light beam. In the case of elliptical reflectors, the light radiated by a lamp located at the first focal point of the ellipse is reflected to the second focal point.

In addition to these reflector designs, double reflector systems, such as that disclosed in U.S. Pat. No. 5,097,401 to Eppler, consist of a primary and secondary reflector. The primary reflector aligns the light in a parallel or narrowly focused beam and directs it to a secondary reflector, which then distributes the light. The direct view of the high luminance of the lamp is precluded with such double reflector systems, the purpose being to attempt to provide improved visual comfort within the room of the lighting system.

Further, in U.S. Pat. No. 4,564,892 to Oram, another dual reflector design is illustrated that uses a simple light source to produce two oppositely directed light beams. Again, this design uses a single lamp set between two reflectors to provide scattered light.

SUMMARY OF THE INVENTION

A light reflector assembly for providing selective direct and indirect lighting includes a first curved section and a second curved section that are connected by a central section or by end caps. The first curved section substantially surrounds a first light source to provide direct lighting for the user, and the second curved section substantially surrounds a second light source to provide indirect lighting for the user, either at the same time or independently, as desired by the user.

BRIEF DESCRIPTION OF THE DRAWINGS

FIG. 31*a* is a perspective view of a eighth embodiment of the light reflector assembly;

FIG. 31*b* is a sectional view of the eighth embodiment of the light reflector assembly illustrated in FIG. 31*a* taken along the lines 31*a*-31*a;*

DESCRIPTION OF THE PREFERRED EMBODIMENT

Figure 1:
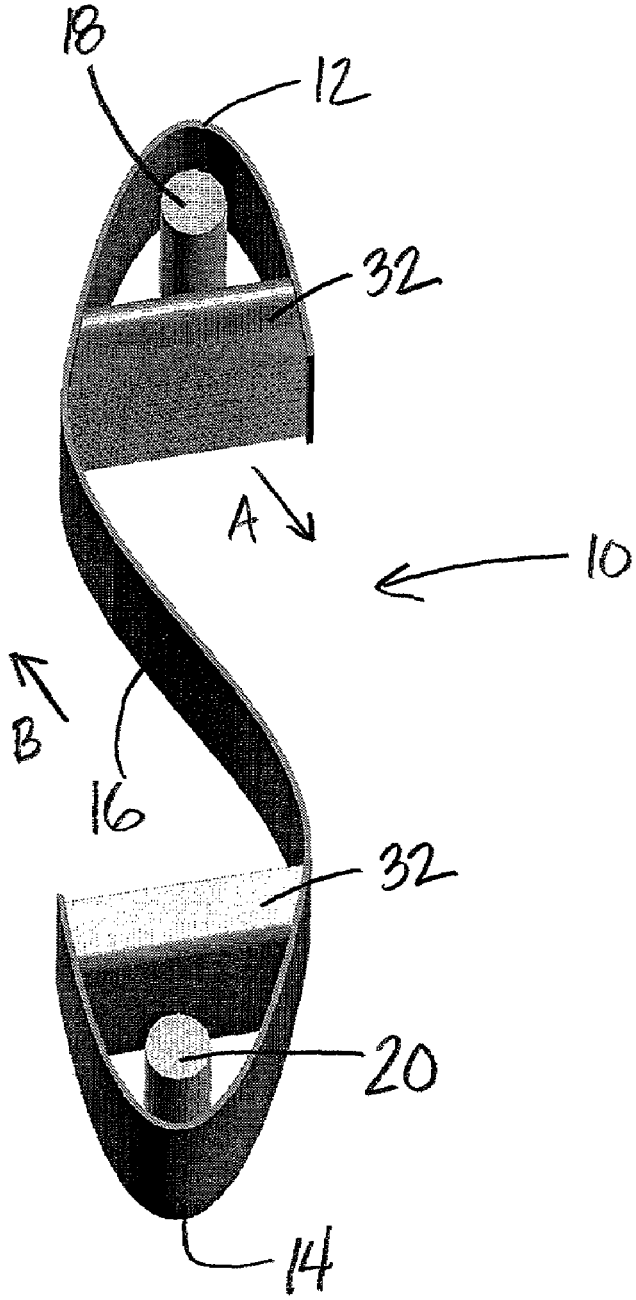
FIG. 1 is a side elevational view of a light reflector assembly as described herein.
Figure 2:
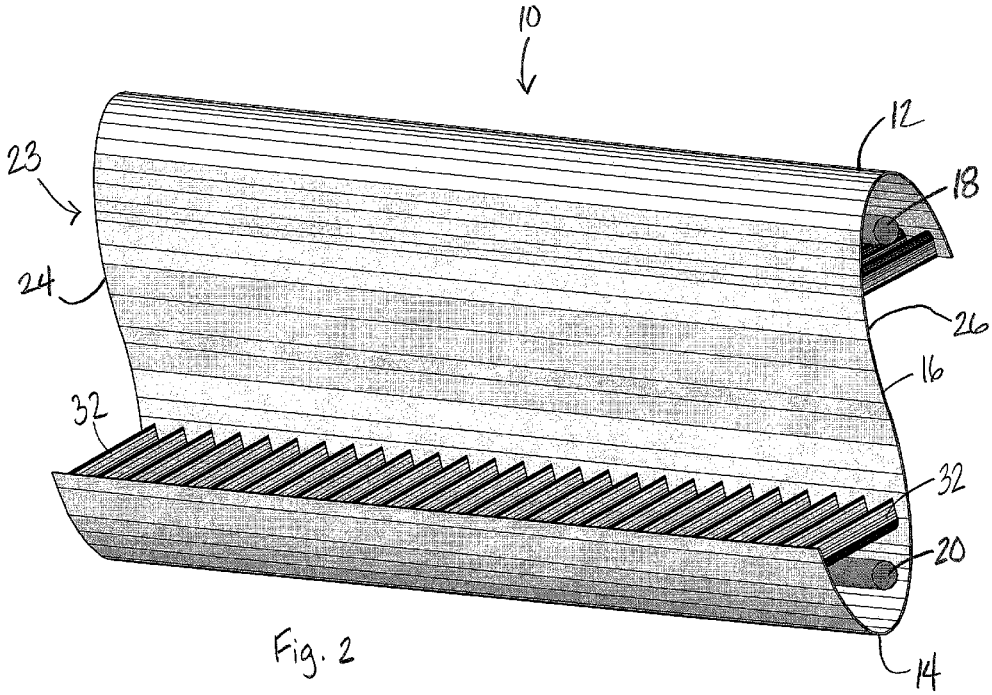
FIG. 2 is a perspective view of the light reflector assembly as described herein.

A light reflector assembly 10 that provides direct and indirect illumination in an area proximate or near to the light reflector assembly 10 is illustrated in the attached drawings. In particular, the light reflector assembly 10 has substantially an S-shape (see FIG. 1) that is used to selectively provide direct and/or indirect lighting in a general area as shown in FIGS. 1-8. In particular, the light reflector assembly 10 has a double curve reflector, with a first section 12 and a second section 14 that are respectively curved or bent. These sections 12, 14 may further be connected by a central section 16 or via end caps, as described herein. The first section 12 and the second section 14 are designed such that both coincide with independent light sources 18, 20, with the first section 12 providing direct lighting in the direction A and the second section 14 providing an indirect lighting directed in the direction B. If the second section 14 is the lowermost section, then the light from the first lamp 18 will be aimed downwardly for direct lighting, and the light from the second lamp 20 will be aimed upwardly away from the area below the light reflector 10 to provide indirect lighting. Furthermore, although one embodiment of the invention shows that the first and second sections 12, 14 are curved, it is noted that they could be any shape that provides the desired reflection of light in the respective directions A and B. For example, the first and second sections could be bent to have a triangular shape, rectangular shape, hexagonal shape, or some other desirable shape that partially surrounds the light sources 18, 20 to reflect the light in the desired directions A, B.

The light reflector 10 can be used in conjunction with a variety of lamps 18, 20 and ballasts 22. For example, the light reflector 10 can be attached between single-ended wall mounts with a first lamp or lamps 18 centrally located proximate the first section 12 of the light reflector 10 and a second lamp or lamps 20 centrally located in the second section 14 of the light reflector 10 via lamp mounts 18*a*, 20*a*. When the light reflector 10 is in a vertical position and both the first and second lamps 18, 20 are illuminated, light is reflected downwardly from the first, upper section 12 of the light reflector 10 and upwardly from the second, lower section 14 of the light reflector 10. However, it is to be noted that the light reflector 10 may also be mounted in a primarily horizontal position to further distribute the light as desired by the user.

The use of these two light sources 18, 20 in opposite directions provides selectively controlled indirect and direct lighting for the surrounding area. That is, when both light sources 18, 20 are illuminated, light will be directed upwardly (indirectly) and downwardly (directly). However, it is also possible that one light source 18, 20 may be illuminated while the other is not illuminated. This controlled illumination allows the user to determine the direction of the light as desired according to whether direct lighting or indirect lighting is appropriate for a particular room at a particular time. For example, the user may determine when light is to be directed downwardly, or when light is to be directed upwardly, or when light is to be transmitted concurrently in both directions, and easily select the desired choice using the respective lamp 18, 20 surrounded by the present reflector 10.

Figure 3:
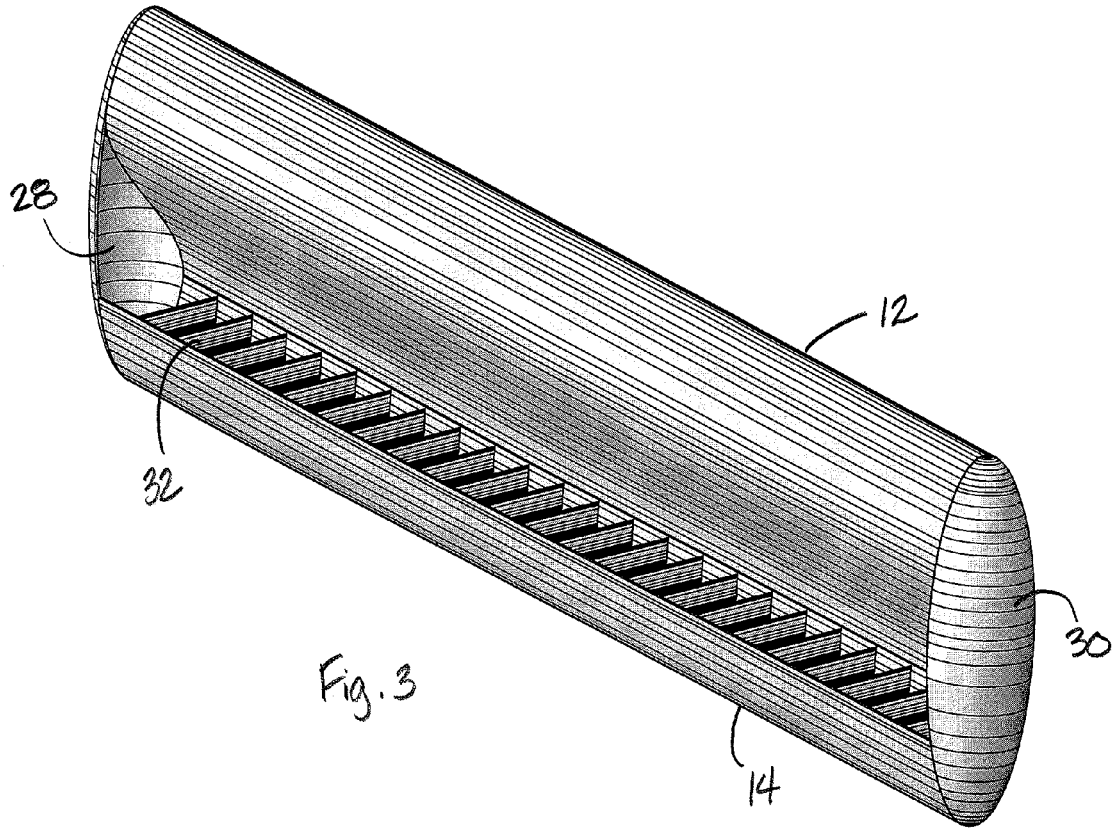
FIG. 3 is a perspective view of the light reflector assembly illustrated in FIG. 2, with the addition of end caps attached to the light reflector.
Figure 4:
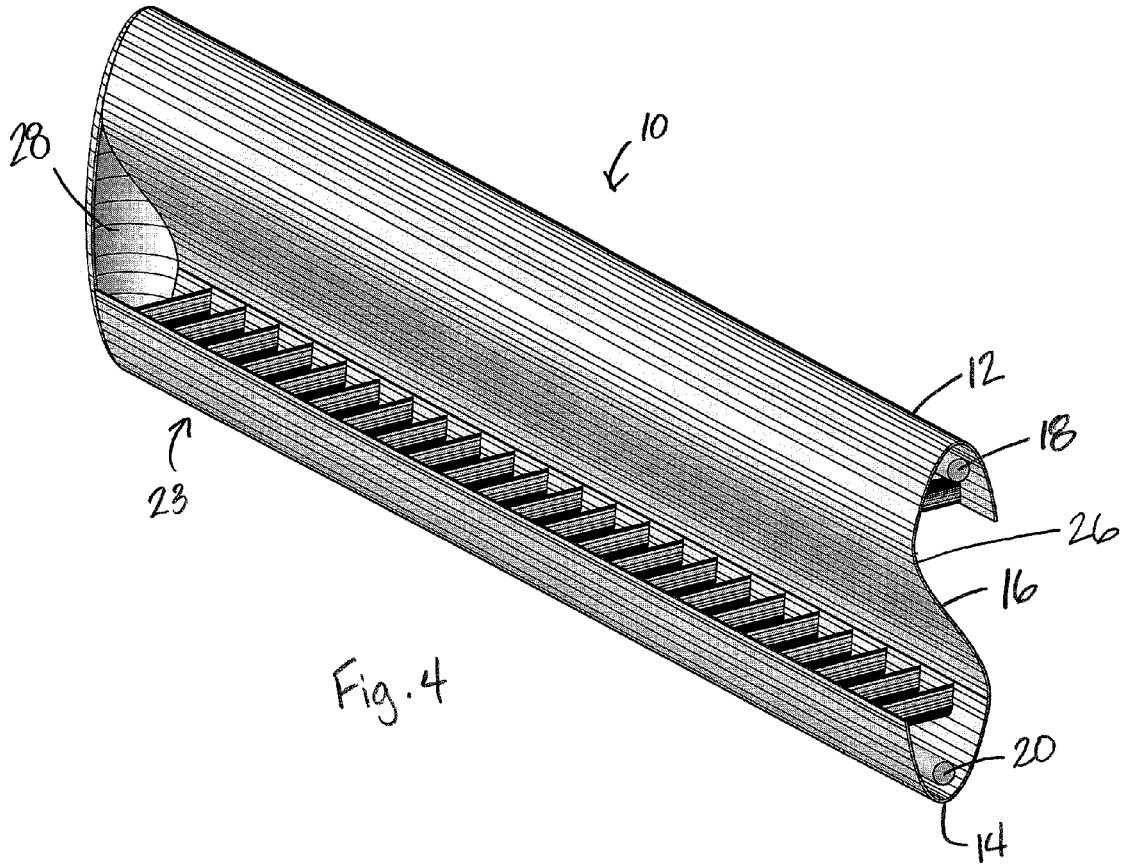
FIG. 4 is a perspective view of the light reflector assembly illustrated in FIG. 3, with one end cap removed.
Figure 5:
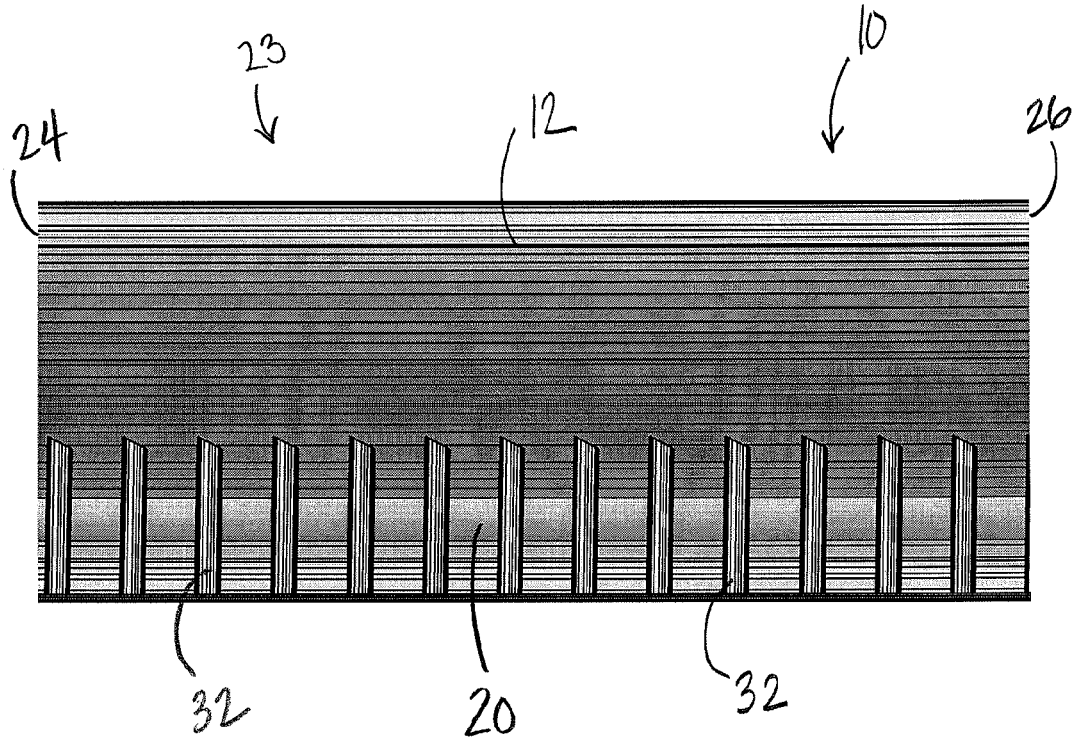
FIG. 5 is a top plan view of the light reflector assembly illustrated in FIG. 2.

Looking further to the embodiments of the light reflector 10 illustrated in FIGS. 1-8, the light reflector 10 is a linear module 23 that has two ends 24, 26 that may be suspended by cables 25 (such as aircraft cables) or poles that provide power feed to the lamps 18, 20 housed therein as well as a suspension system. Two end caps 28, 30, as shown in FIG. 3, are used at the ends 24, 26 of the continuous runs of the linear module 23. As is illustrated, a series of transverse parabolic reflectors 32 may be included in the first section 12 and the second section 14 to control axial glare from the illuminated lamps 18, 20. The parabolic reflectors 32 are included for maximization of horizontal distribution, diffusion of the light from the lamps 18, 20, glare control, and concealment of the lamps 18, 20 from side viewing angles as well. The parabolic reflectors 32 may be secured in the first and second sections 12, 14 via a number of ways, although in FIG. 7, a series of elliptical tubes 32*a* are positioned between the parabolic reflectors 32 and the first and second sections 12, 14 for a frictional fit.

Figure 8:
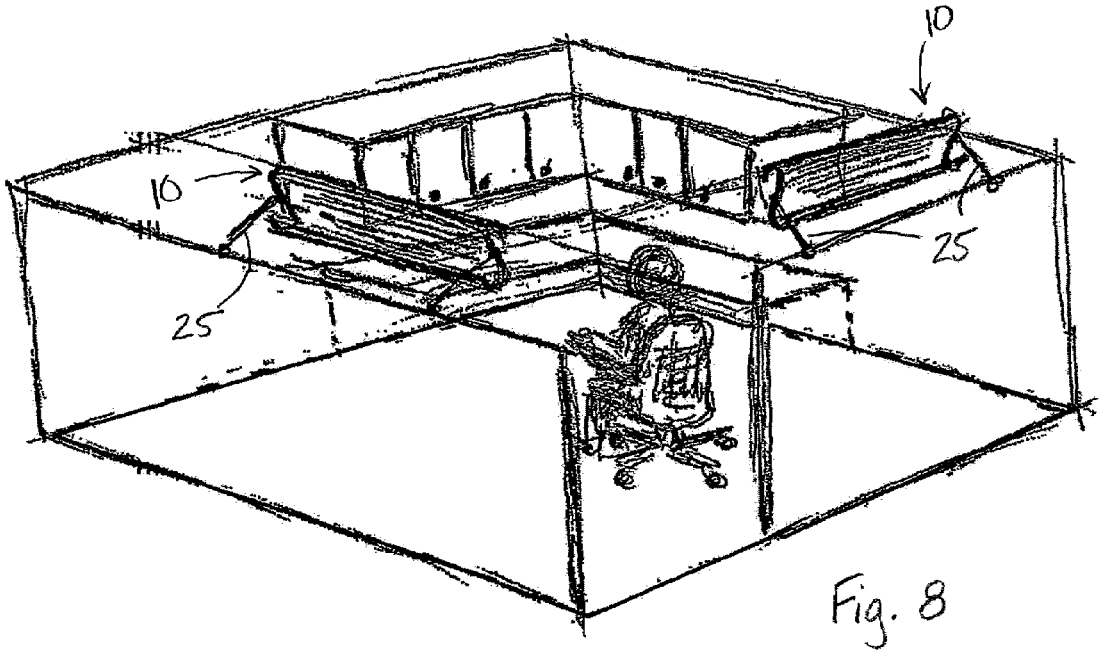
FIG. 8 is a perspective view of a room incorporating two light reflector assemblies.

This linear module 23 could be used in a variety of situations, such as in an office (as illustrated in FIG. 8), where the linear module 23 is desired to have both direct light to illuminate a particular task and an indirect light for a softer lighting effect. Also, the light reflector assembly 10 could be arranged in continuous runs of multiple rows of linear modules 23, such as in an open office environment. When planning an office space with furniture, such light reflector assemblies 10 could reduce the quantity of fixtures required to light the surrounding area, thereby reducing the power used in the office space.

Figure 6:
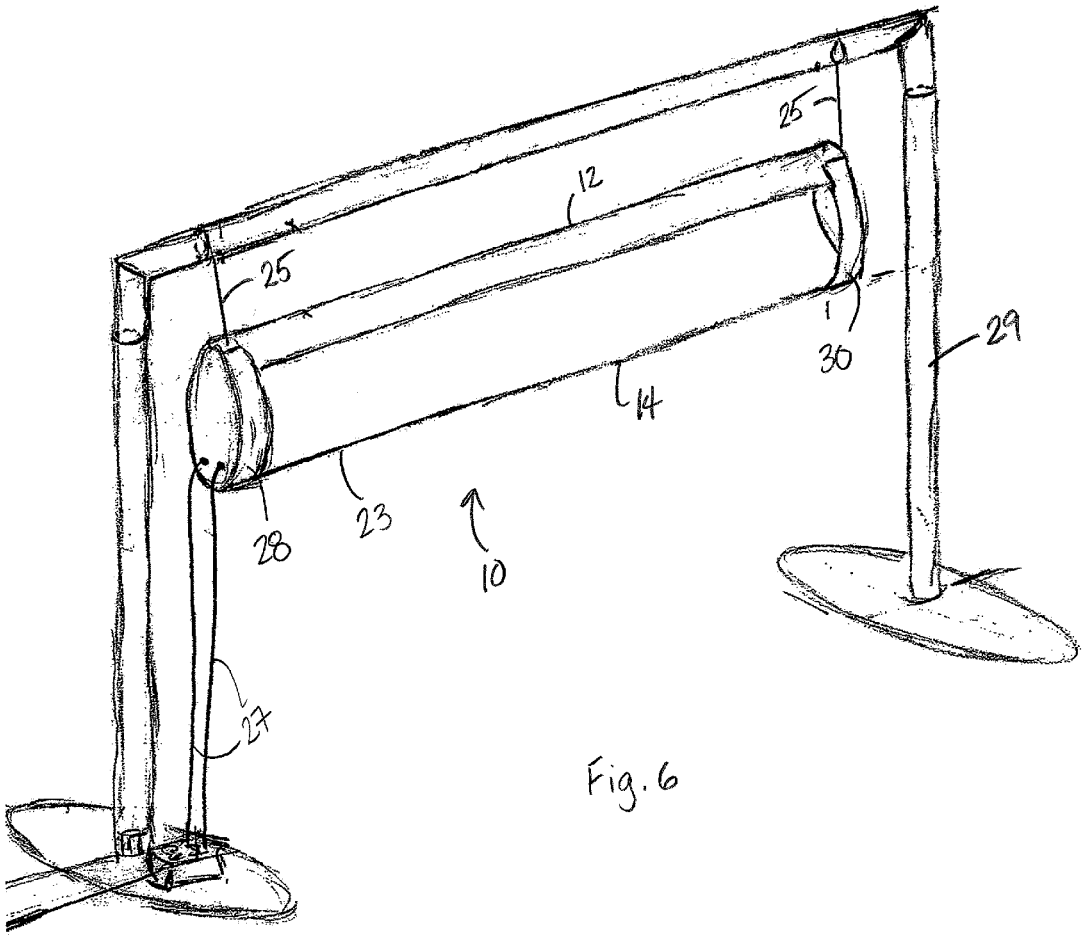
FIG. 6 is a perspective view of the light reflector assembly illustrated in FIG. 3 mounted on a frame.
Figure 7:
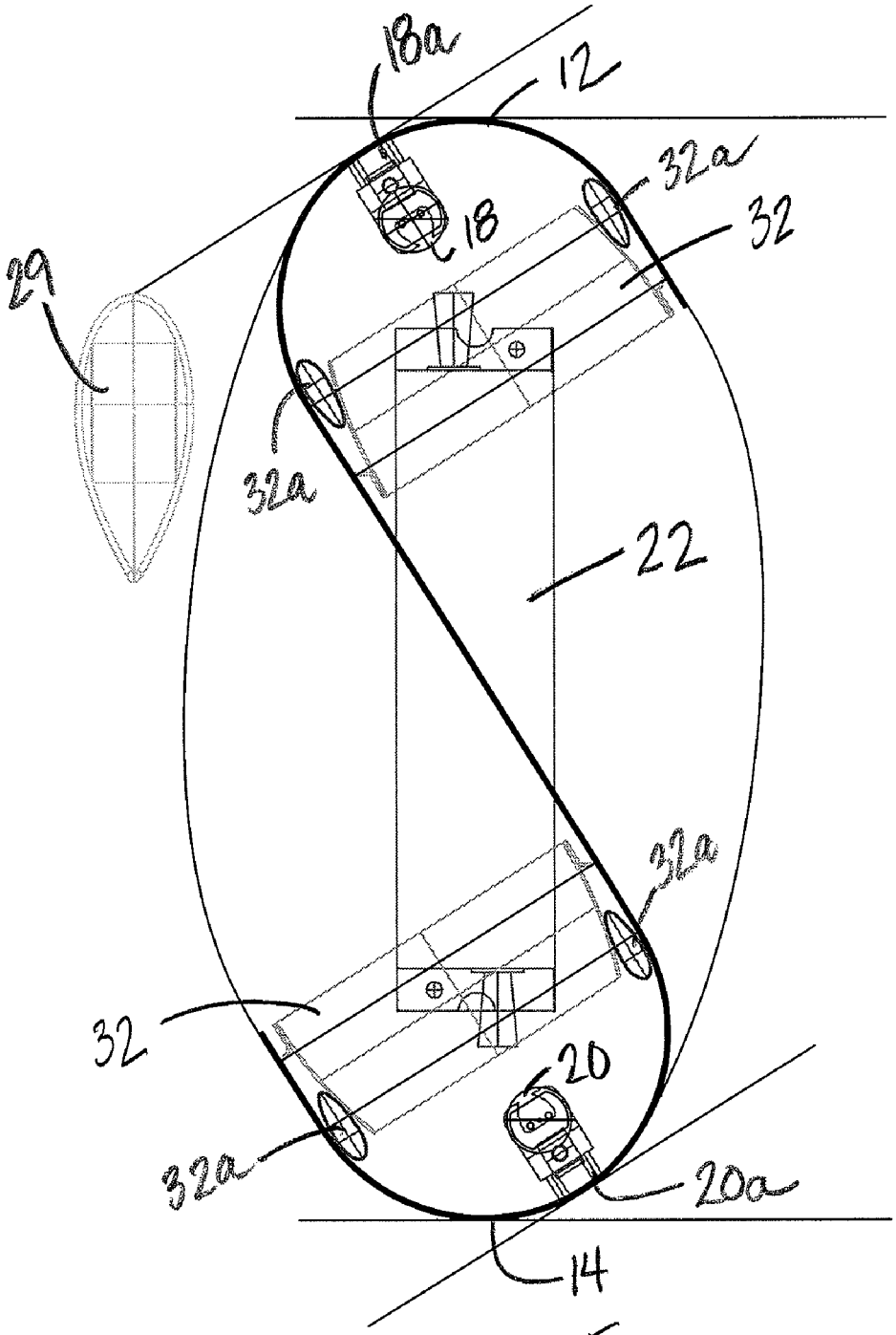
FIG. 7 is a side elevational view of the light reflector assembly with lighting electronics included therewith.
Figure 7A:
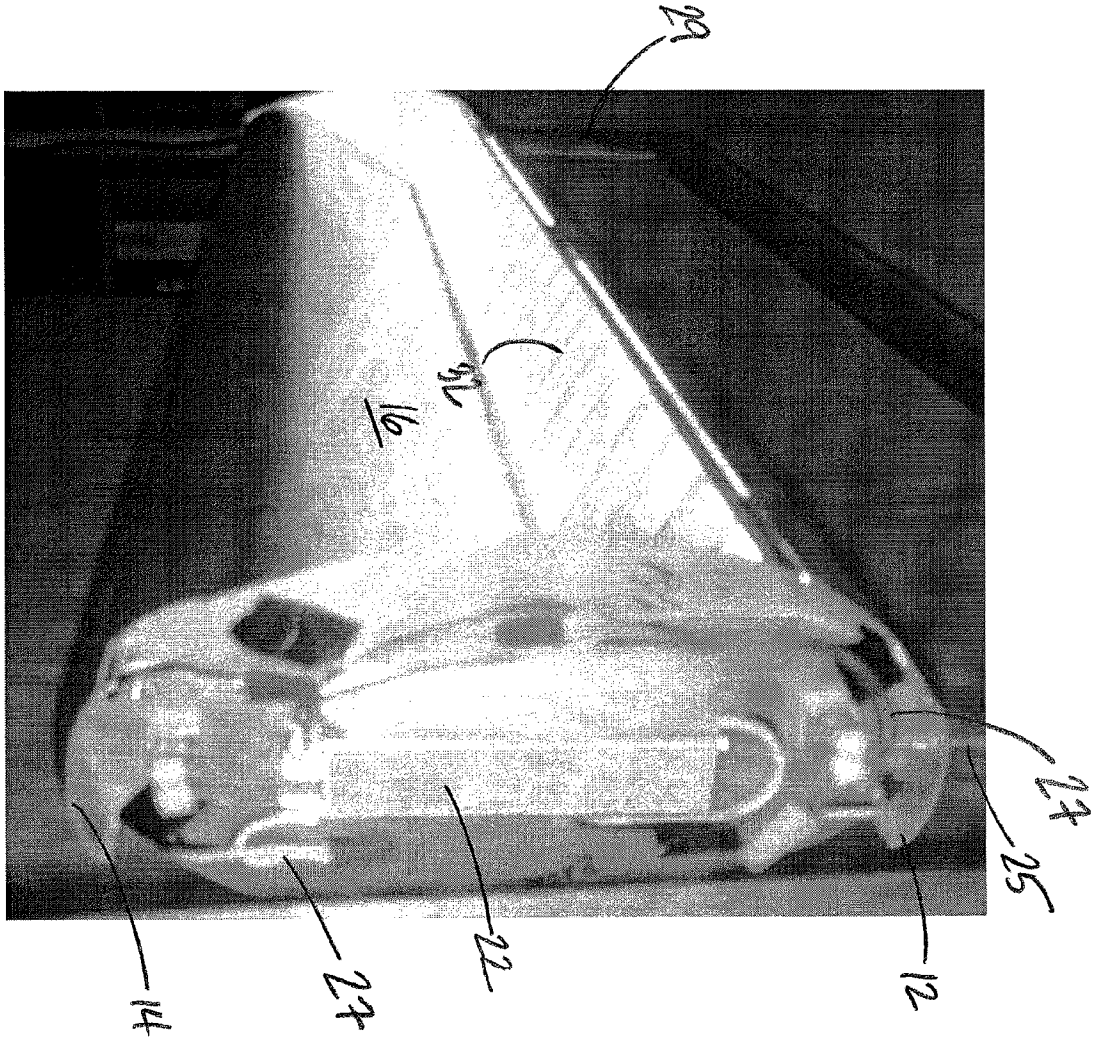
FIG. 7*a* is a photograph of a perspective view of the ballast used with the light reflector assembly as illustrated in FIG. 7.
Figure 7B:
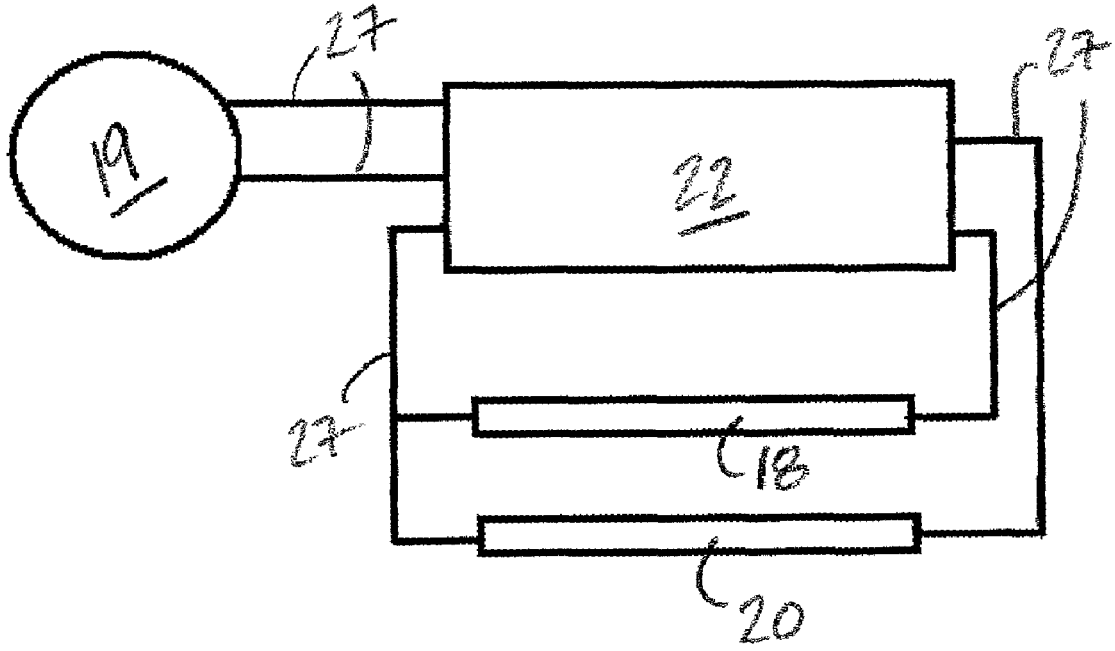
Fig. 7b (prior art)
FIG. 7*b* is a circuit diagram of the connection of the light sources with a ballast and power supply.

Looking further to FIG. 6, the light reflector 10 is supported by a frame 29 and various cables 25. Referring to FIGS. 7*a*-7*c*, power feed lines 27 connect the ballast 22 to a power source 19 and further connect the ballast 22 with the lamps 18, 20 to provide power to the lamps 18, 20. Such a configuration as illustrated in FIG. 7*b* is an example of one of many potential connections between the ballast 22 and the lamps 18, 20. As shown in FIGS. 7 and 7*a*, the ballast 22 may be housed in the end caps 28, 30 for connection with the lamps 18, 20. Of course, the ballast 22 may be located at any other location that is desired or convenient for connection with the lamps 18, 20. The wiring of the lamps 18, 20 with the ballast 22 may be in a conventional configuration as known in the art.

Figure 9:
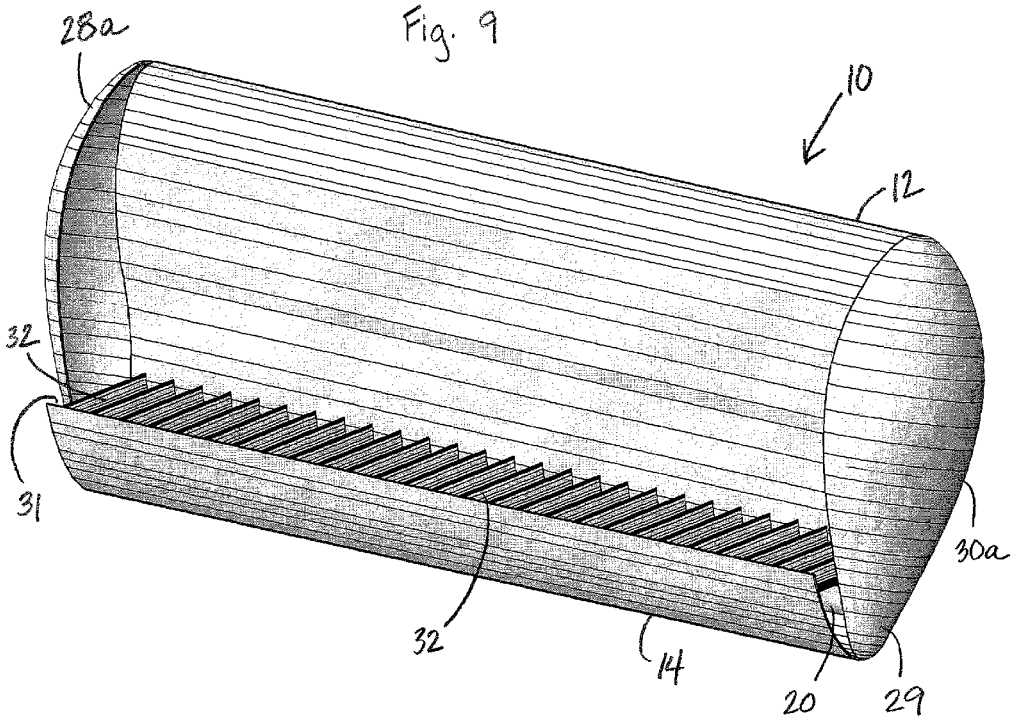
FIG. 9 is a perspective view of a second embodiment of the light reflector assembly.
Figure 10:
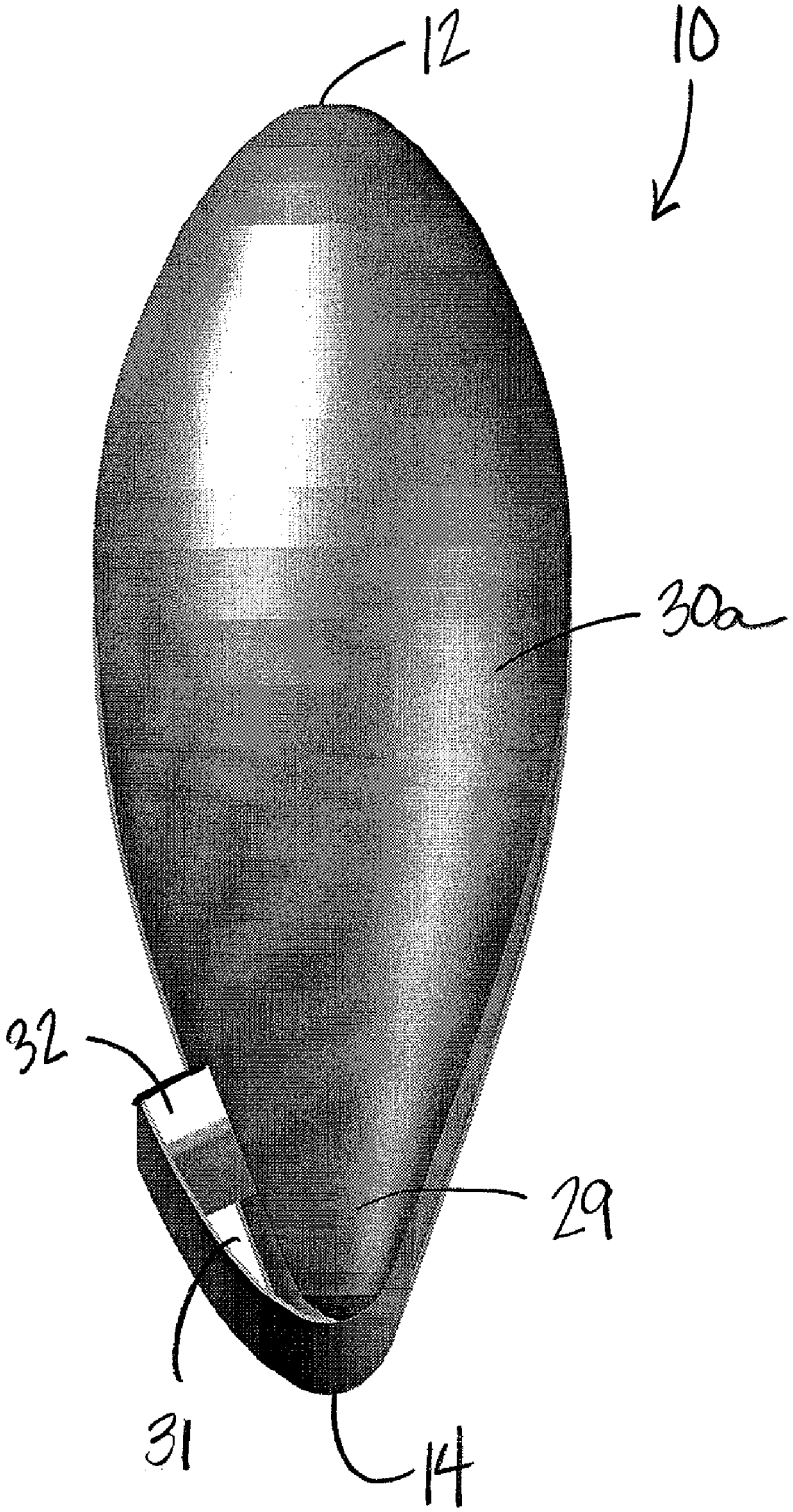
FIG. 10 is a side elevational view of the second embodiment of the light reflector assembly illustrated in FIG. 9.
Figure 11:
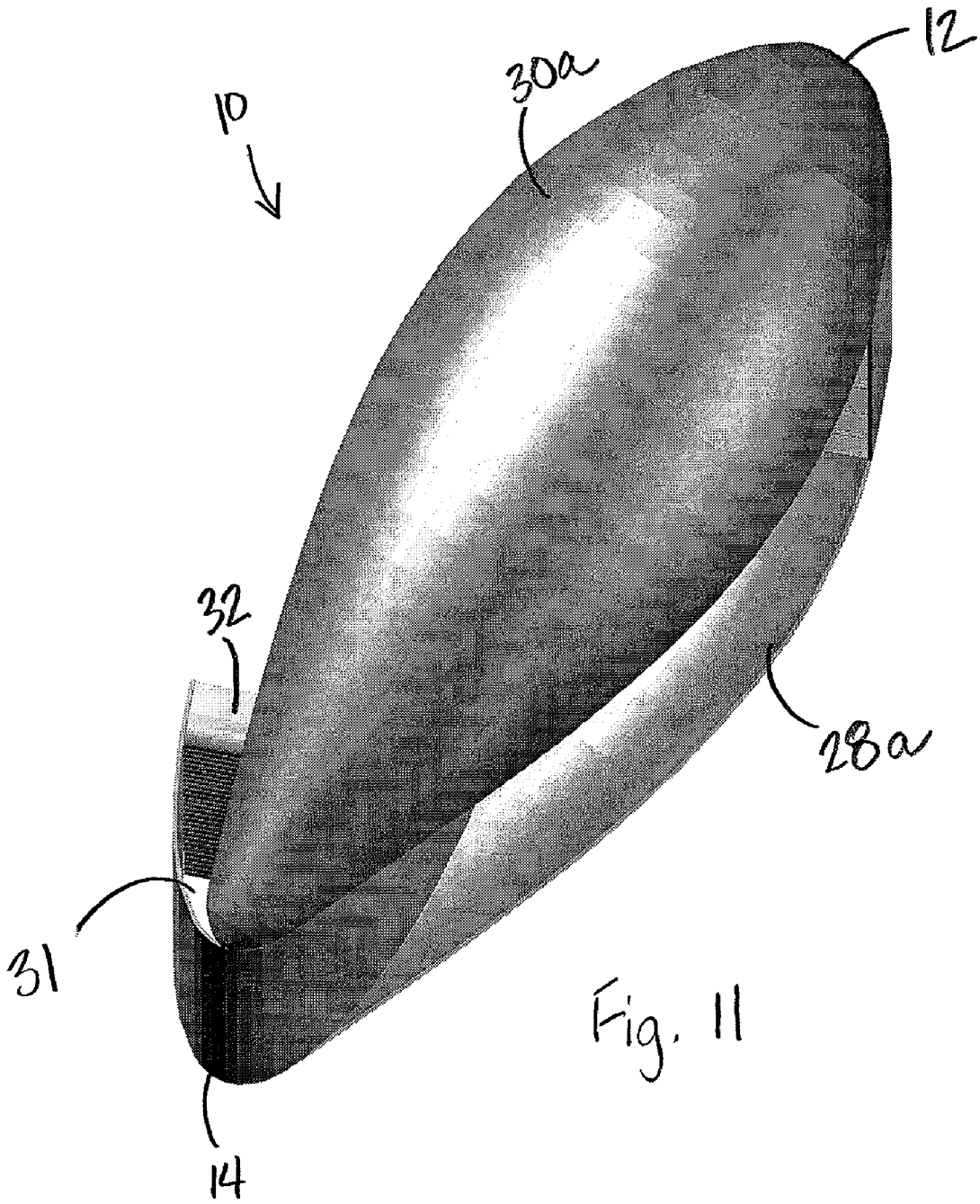
FIG. 11 is a lower perspective view of the second embodiment of the light reflector assembly illustrated in FIG. 9.
Figure 12:
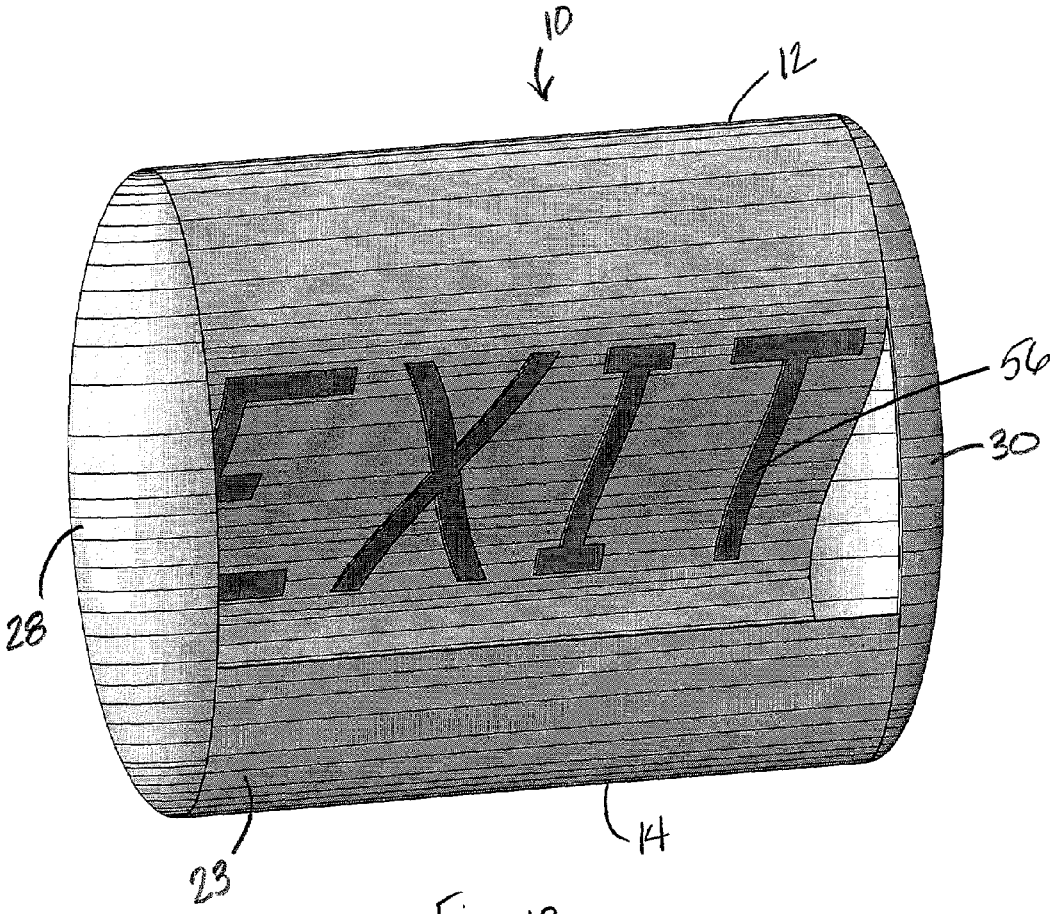
FIG. 12 is a perspective view of a third embodiment of the light reflector assembly.
Figure 13:
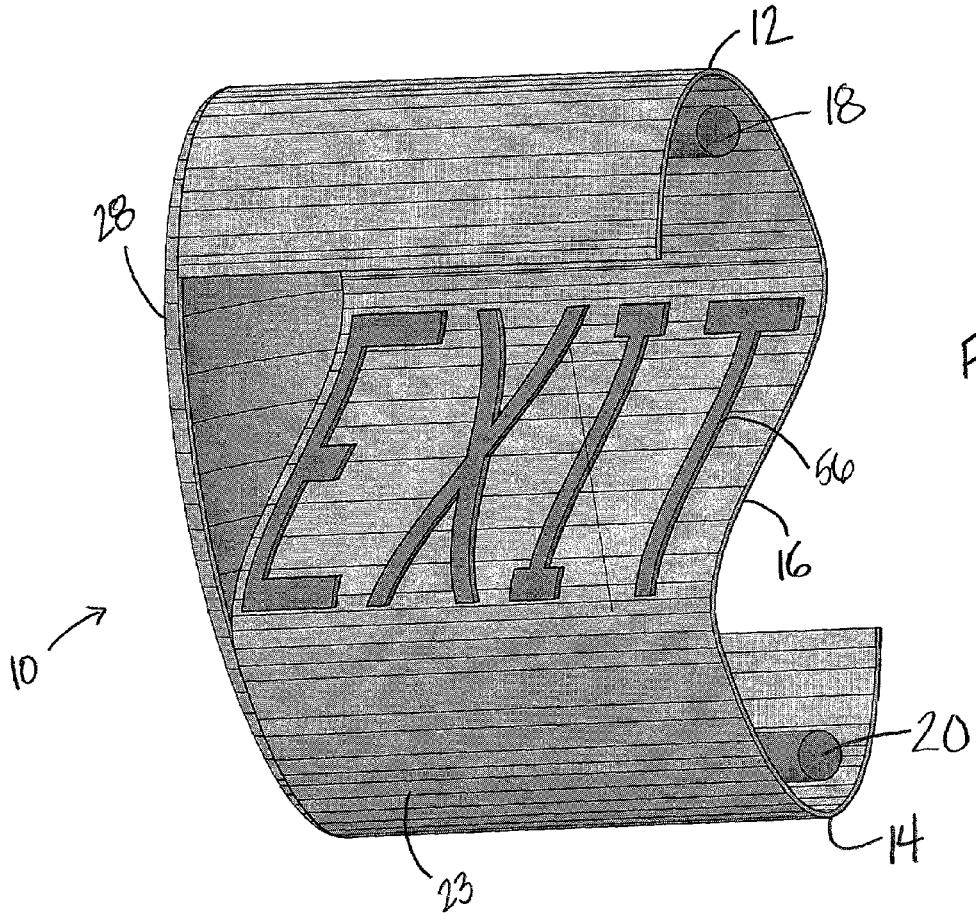
FIG. 13 is a perspective view of the third embodiment of the light reflector assembly illustrated in FIG. 12, with one end cap removed.
Figure 14:
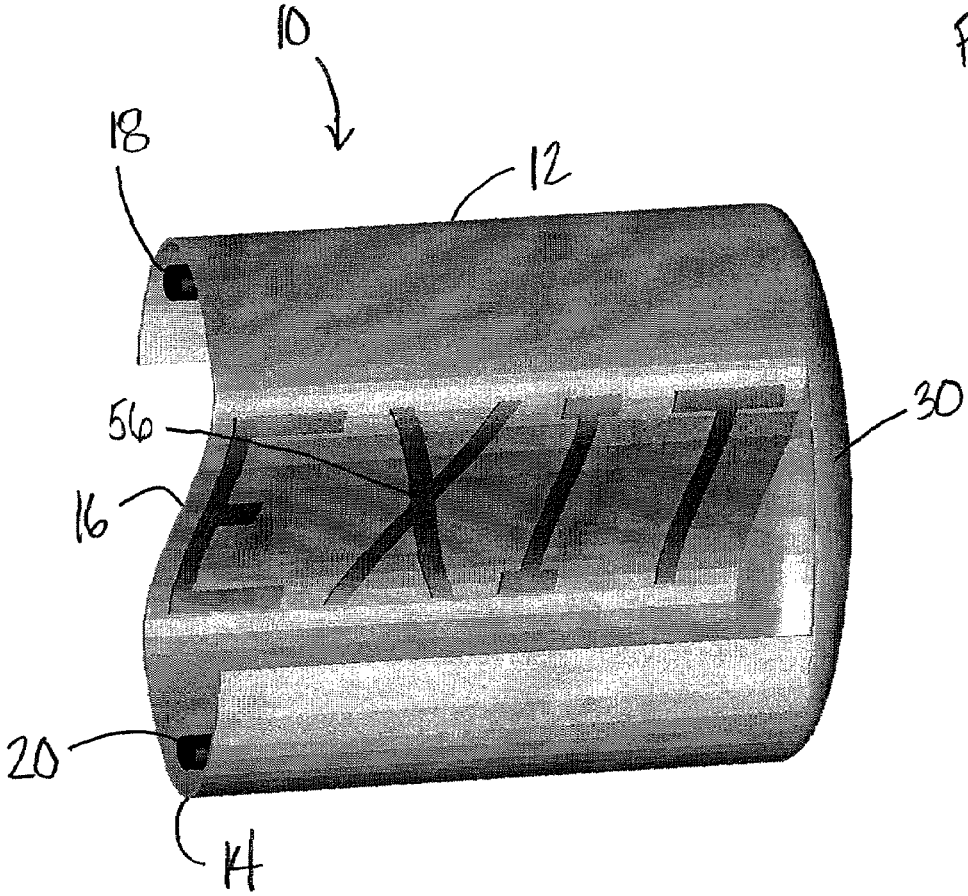
FIG. 14 is a perspective view of the third embodiment of the light reflector assembly illustrated in FIG. 12, with another end cap removed.

Looking further to FIGS. 9-11, another embodiment of the invention provides that the end caps 28*a*, 30*a* do not have an outer design that completely corresponds with the outline of the light reflector 10. For example, one end of the end caps 28*a*, 30*a* may be thinner than the first section of the reflector 10. This design allows light to escape in the gap 31 through the ends 24, 26 and provide a highlight as desired by the user. Furthermore, the end caps 28*a*, 30*b* may have another shape as desired by the user that is not related to the shape of the reflectors 10 in any fashion, such as a rectangular outline, triangular outline, hexagonal outline, or some other desirable shape.

Figure 15A:
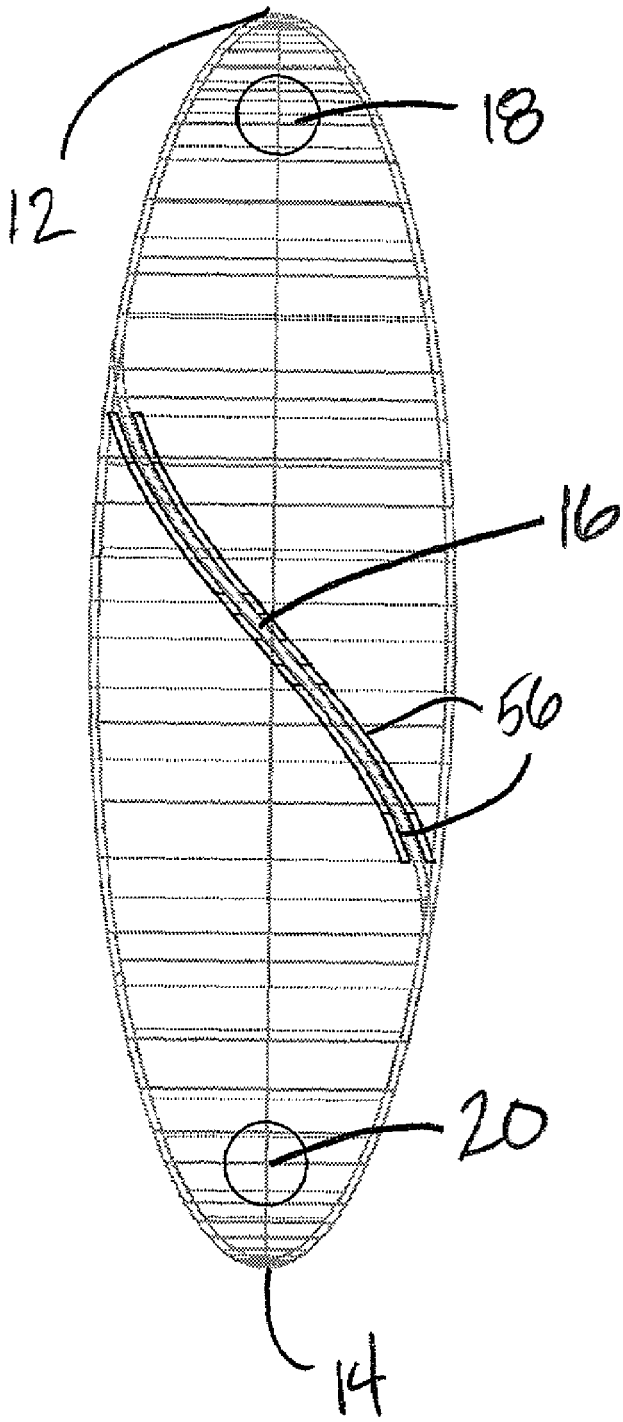
FIG. 15*a* is a sectional view of the third embodiment of the light reflector assembly illustrated in FIG. 12.
Figure 15B:
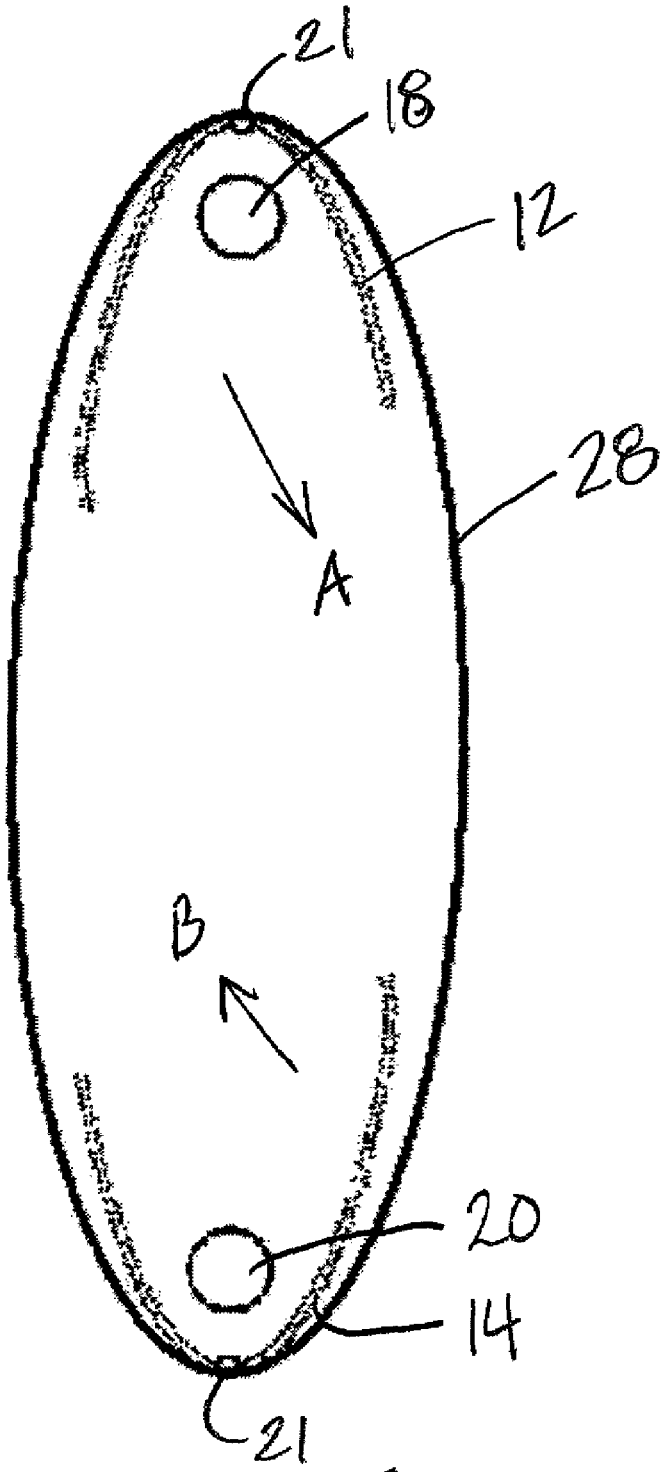
FIG. 15*b* is a sectional view of the third embodiment of the light reflector assembly with the first section and second section pivotally connected to the end cap.
Figure 16:
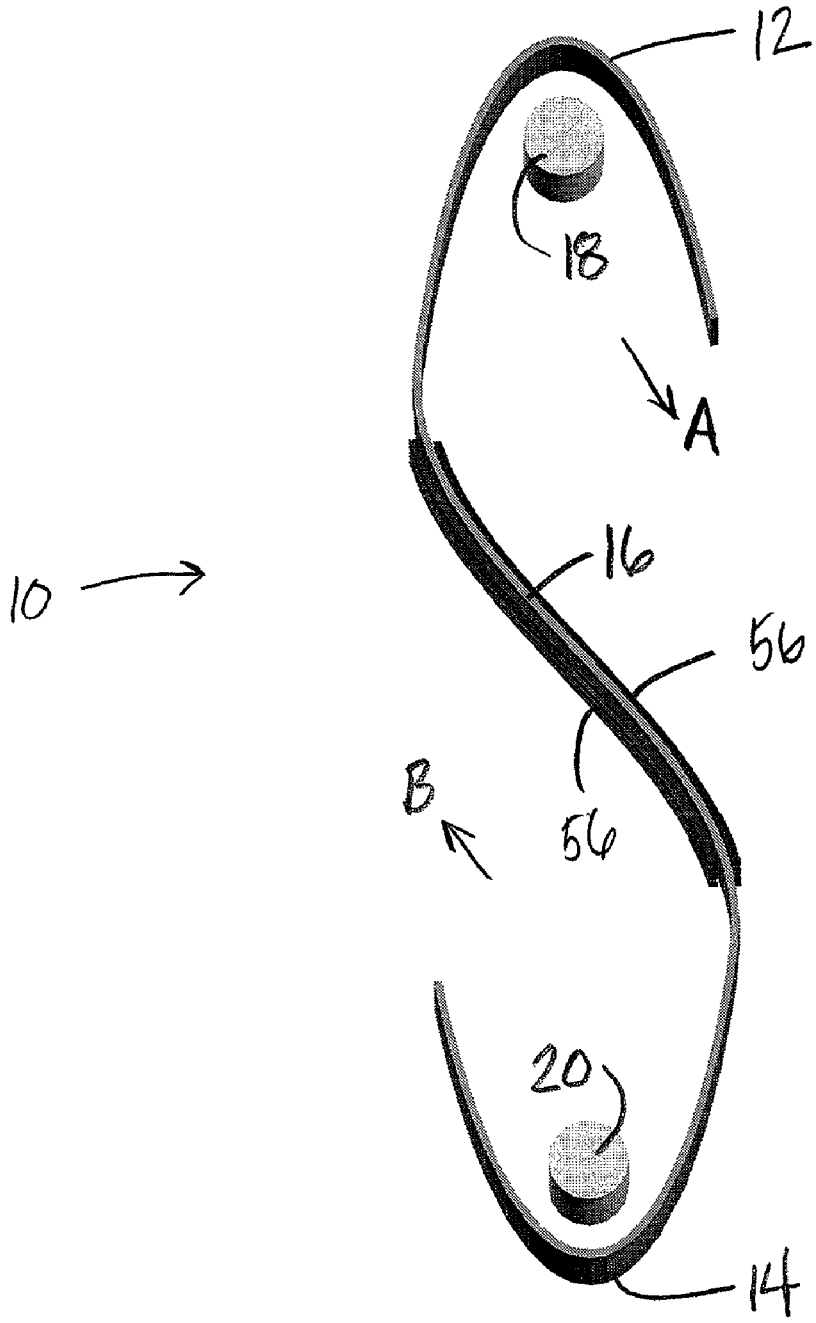
FIG. 16 is a side elevational view of the light reflector assembly of the third embodiment, illustrating translucent connecting members.
Figure 17:
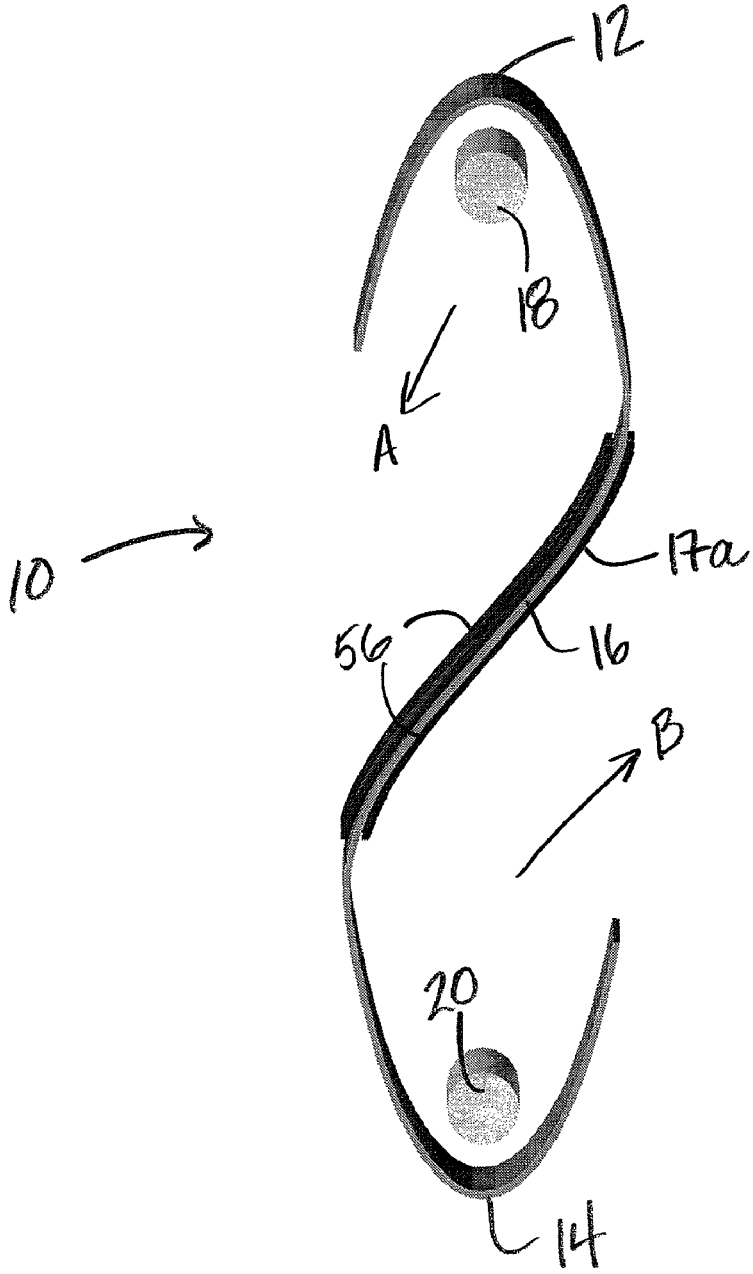
FIG. 17 is a side elevational view of the light reflector assembly of the third embodiment illustrated in FIG. 16 in an opposite orientation for lighting.

Looking to FIGS. 12-17, the light reflector 10, using a linear module 23 with two end caps 28, 30, is used to allow light to bleed through the central section 16, such as for an "EXIT" or other directional sign. In this embodiment, the connecting or central section 16 of the light reflector 10 may be replaced with a translucent panel 56, or a series of apertures may traverse the central wall 16. This allows light from both lamps 18, 20 to highlight the translucent panel 56 or apertures. Consequently, the translucent panel 56 may include a word or sign (e.g., "EXIT"), such that the light transmitted from the first section 12 of the light reflector 10 will radiate through the translucent connecting panel 56 while the light transmitted from the lower section 14 of the light reflector 10 will reflect up towards the translucent connecting panel 56. Furthermore, a comparison of the embodiments shown in FIGS. 16 and 17 shows that the reflector 10 may be oriented as desired by the user so that light is aimed in directions A and B as desired by the user.

By providing this dual lighting, the light reflector 10 is able to more efficiently broadcast the message to the viewing public. Furthermore, the brightness of either the lamps 18, 20 corresponding to the first section 12 or the light corresponding to the lower section 14 can be adjusted by the user to provide the desired effect with the sign to draw attention to the sign or the path. In addition, by using these Exit signs, and due to their ability to significantly contribute to the overall maintained footcandle level in the surrounding room, the possibility exists to reduce the quantity of general illumination fixtures required to achieve the requirements set by the Illuminating Engineering Society for maintained footcandles within a particular space, and thereby achieve an overall energy reduction for the entire building where this embodiment is implemented. Moreover, this Exit sign will significantly illuminate the path of egress for patrons rather than simply identifying the path for patrons.

Furthermore, as shown in FIG. 15*b*, all or a portion of the central section 16 may be removed from the embodiment. In such an embodiment, the first section 12 will direct light in the general direction A and the second section 14 will direct light in the general direction B based on the position of the sections 12, 14 with respect to the lamps 18, 20, but the light will also freely pass through the area between the two sections 12, 14 where the central section 16 is removed. In this embodiment, the end cap 28, or some other plate or frame, will secure the first and second sections 12, 14 in place via connectors 21, which may be located and adjusted with respect to the end cap 28 or plate as desired by the user. The rotational position of the first and second sections 12, 14 may be varied as desired by the user, and the relative angles of position with respect to a central axis (either vertical or horizontal) may vary as desired by the user. Consequently, it is foreseen that the directions A, B of light may be varied independently by each section 12, 14.

Figure 18:
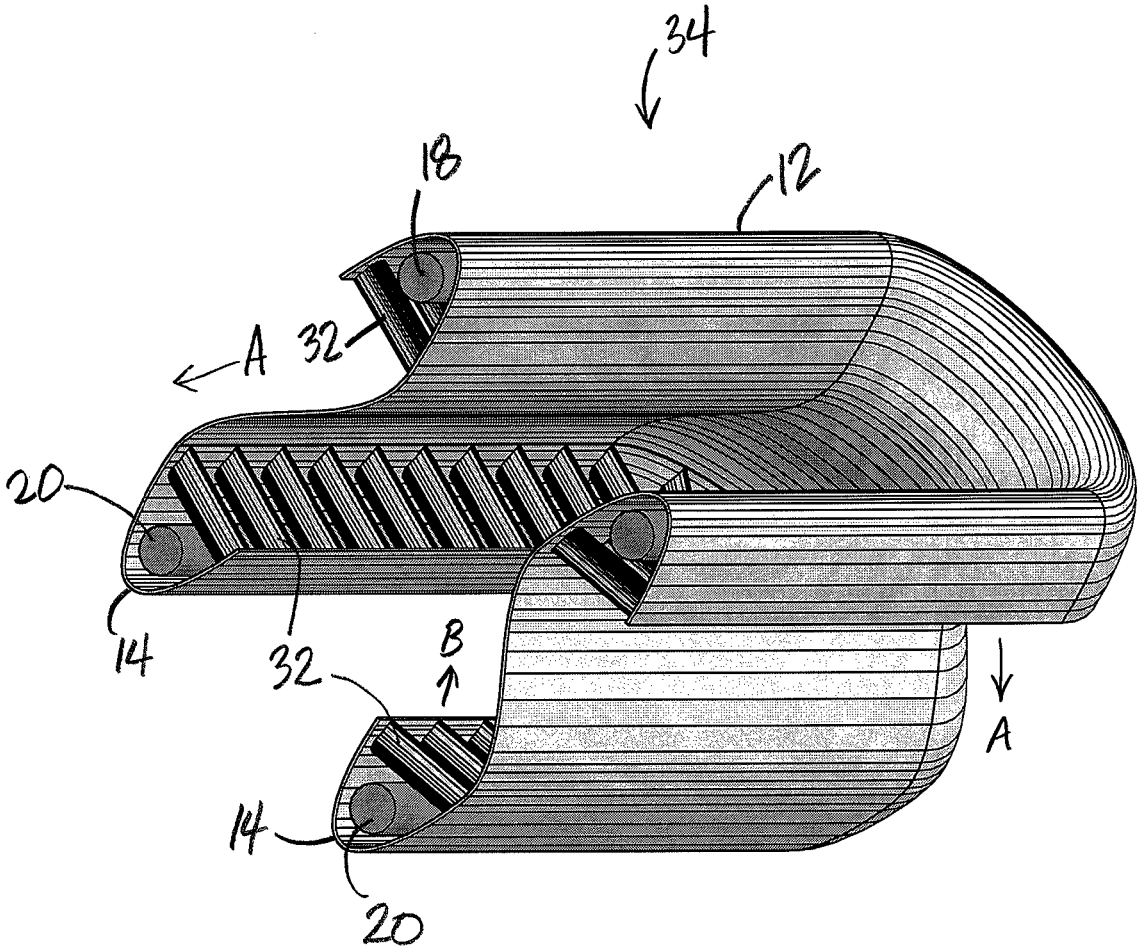
FIG. 18 is a perspective view of a fourth embodiment of the light reflector assembly.
Figure 19:
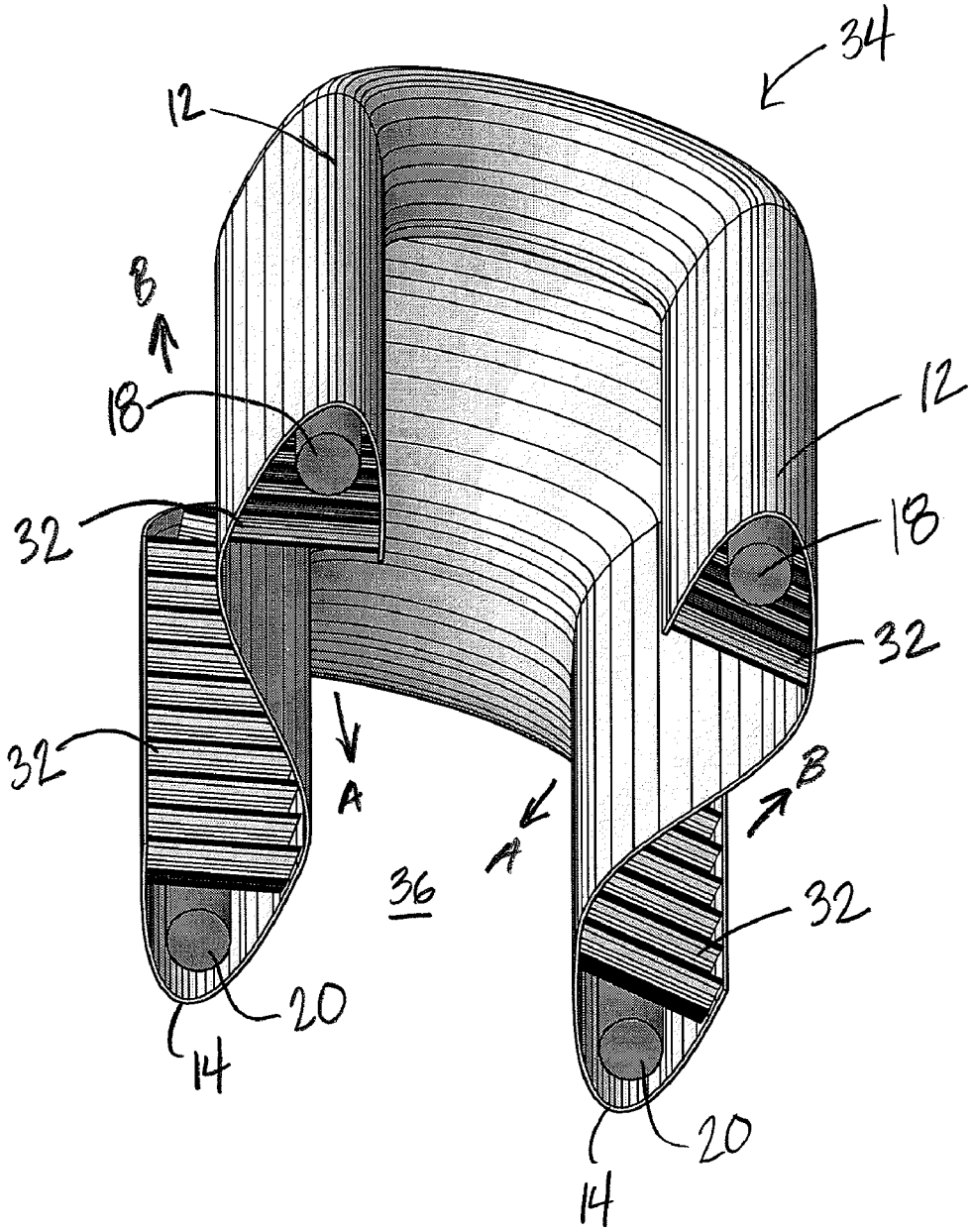
FIG. 19 is a second perspective view of a fourth embodiment of the light reflector assembly illustrated in FIG. 18.
Figure 20:
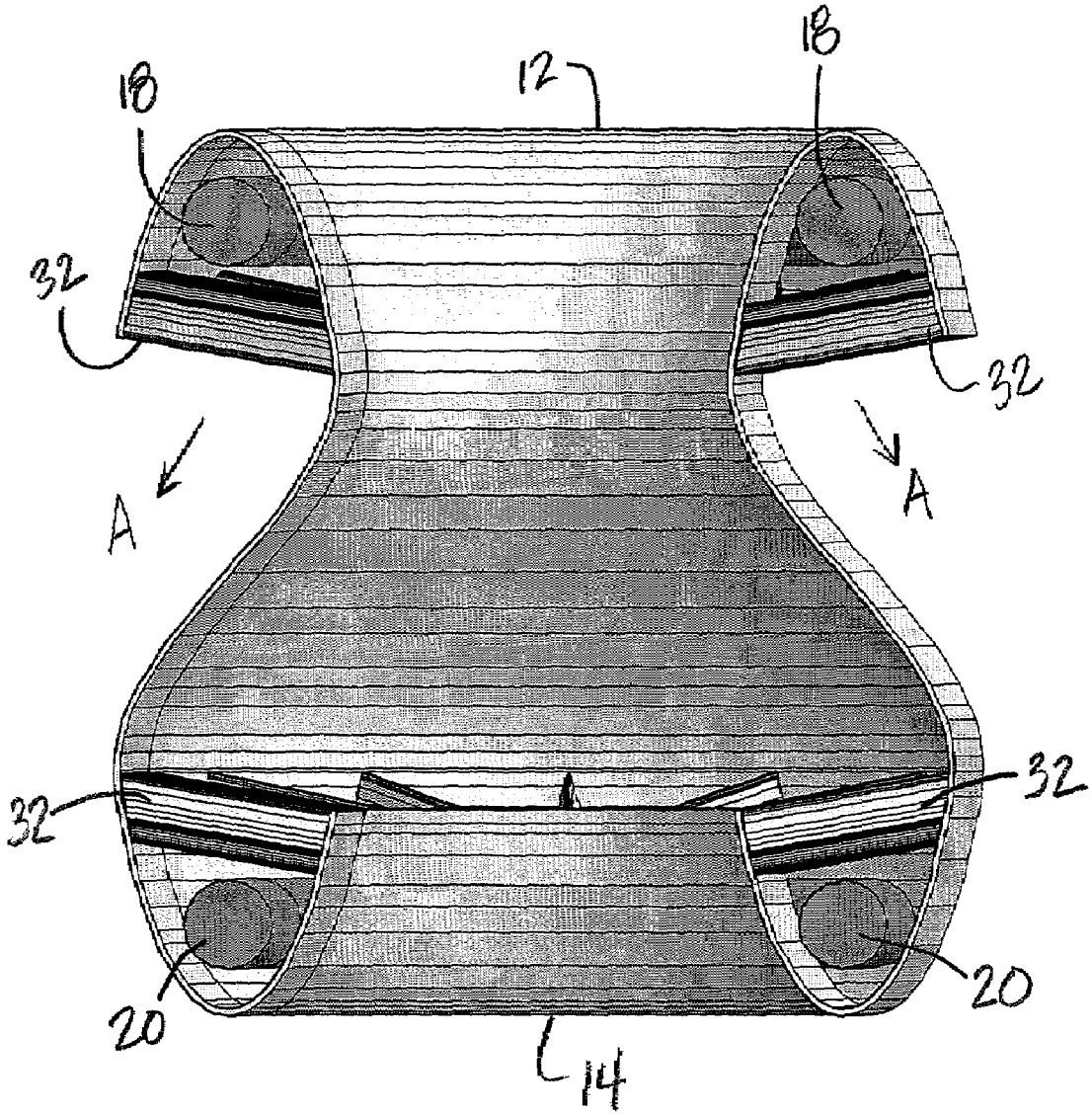
FIG. 20 is an end elevational view of the fourth embodiment of the light reflector assembly illustrated in FIG. 18.

In addition to straight linear modules 23 described above, additional embodiments of the reflector 10 provide for the desired lighting of a room or area. Looking to FIGS. 18-20, a U-shaped module 34 incorporating the light reflector 10 is illustrated. Like the linear module 23, the U-shaped module 34 includes a first section 12 supporting a first lamp 18 and a second section 14 supporting a second lamp 20. In the a U-shaped module 34, the second section 14 of the light reflector 10 will aim light in a direction B to provide the desired indirect lighting, while the first section 12 will either broadcast a direct light in the direction A to the area surrounding the U-shaped module 34 (see FIG. 20) or into a center area 36 surrounded by the U-shaped module 34 (see FIG. 19), depending on the orientation of the light reflector 10.

Figure 21:
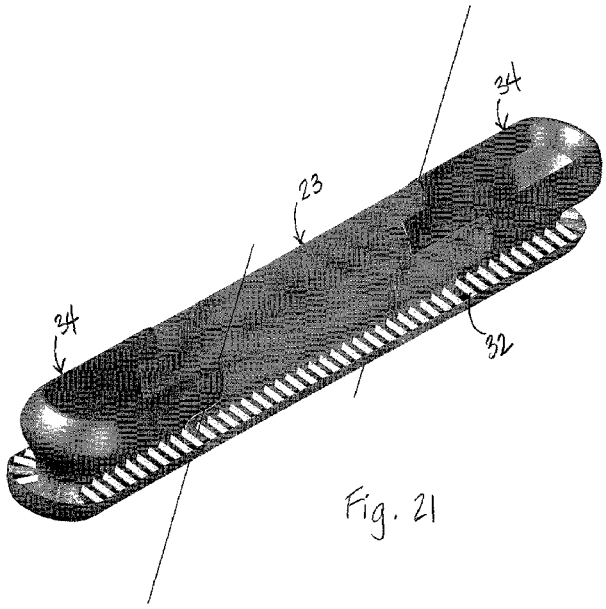
FIG. 21 is a perspective view of a combination of the light reflector assemblies illustrated in FIGS. 2 and 18.
Figure 22:
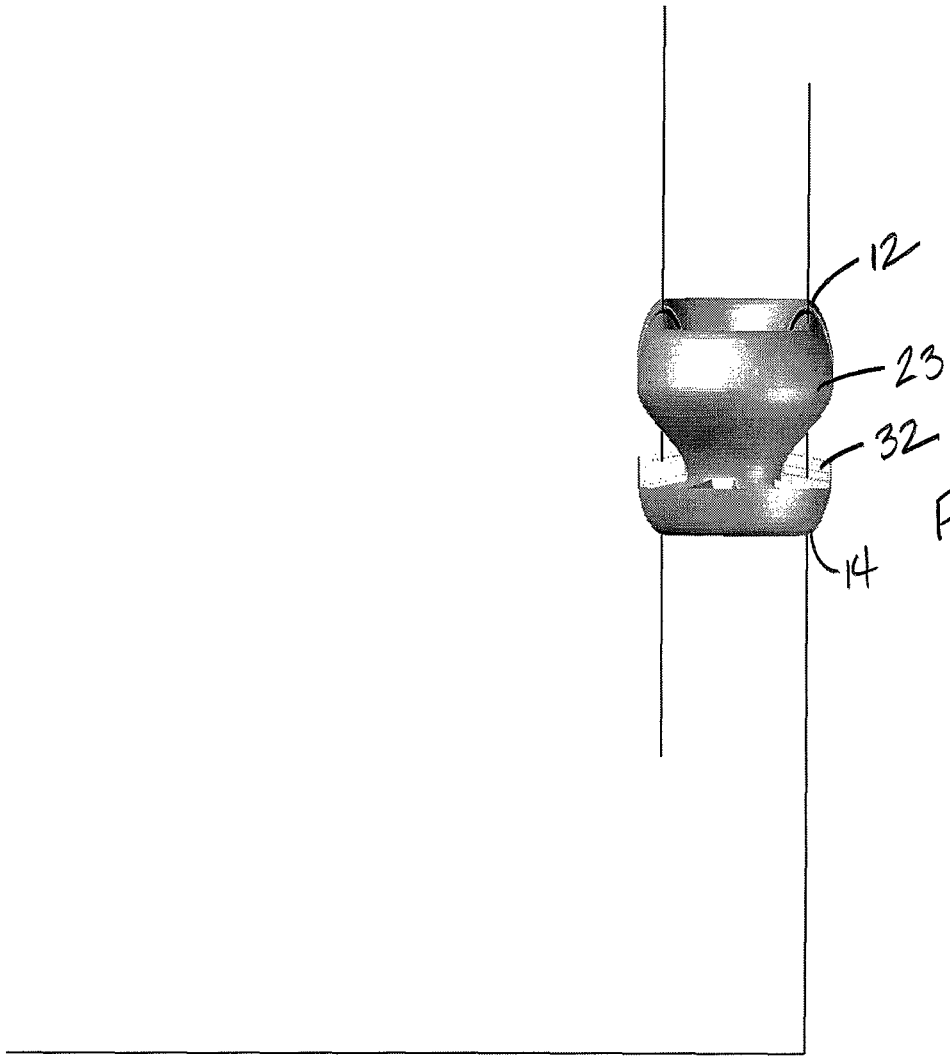
FIG. 22 is an end elevational view of the embodiment illustrated in FIG. 21.
Figure 23:
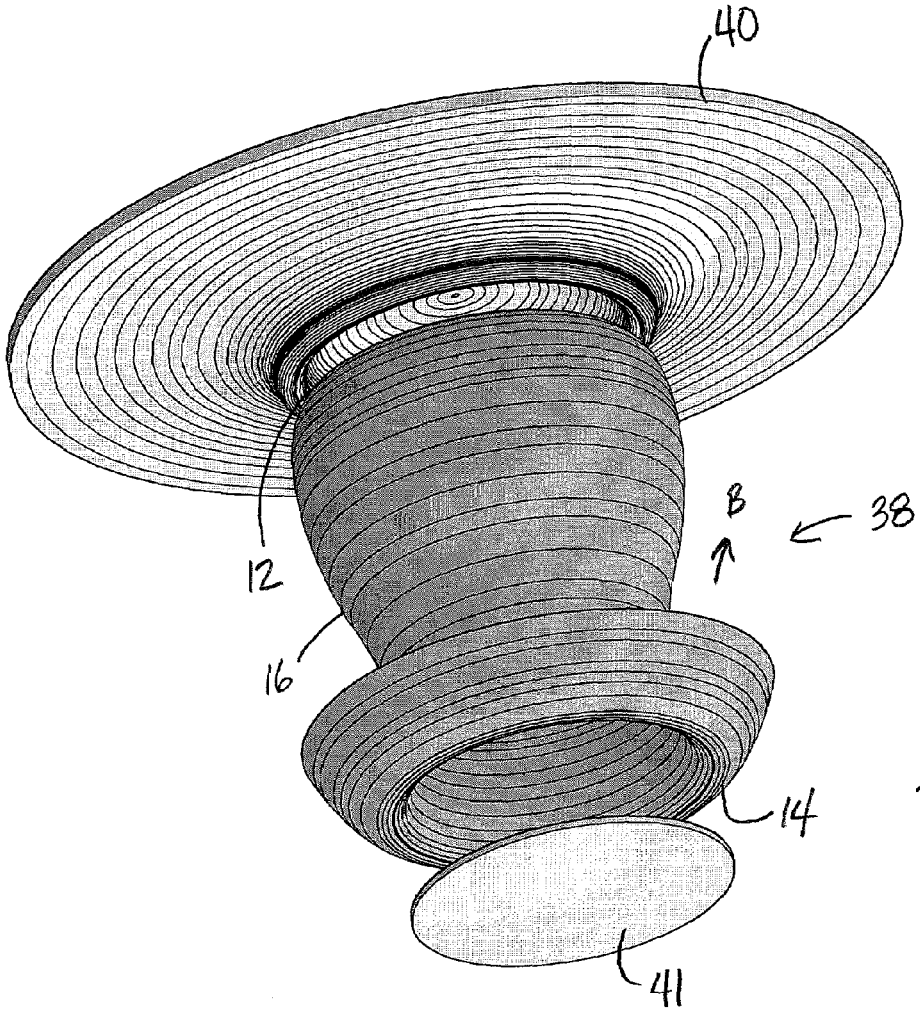
FIG. 23 is a perspective view of a fifth embodiment of the light reflector assembly.
Figure 23A:
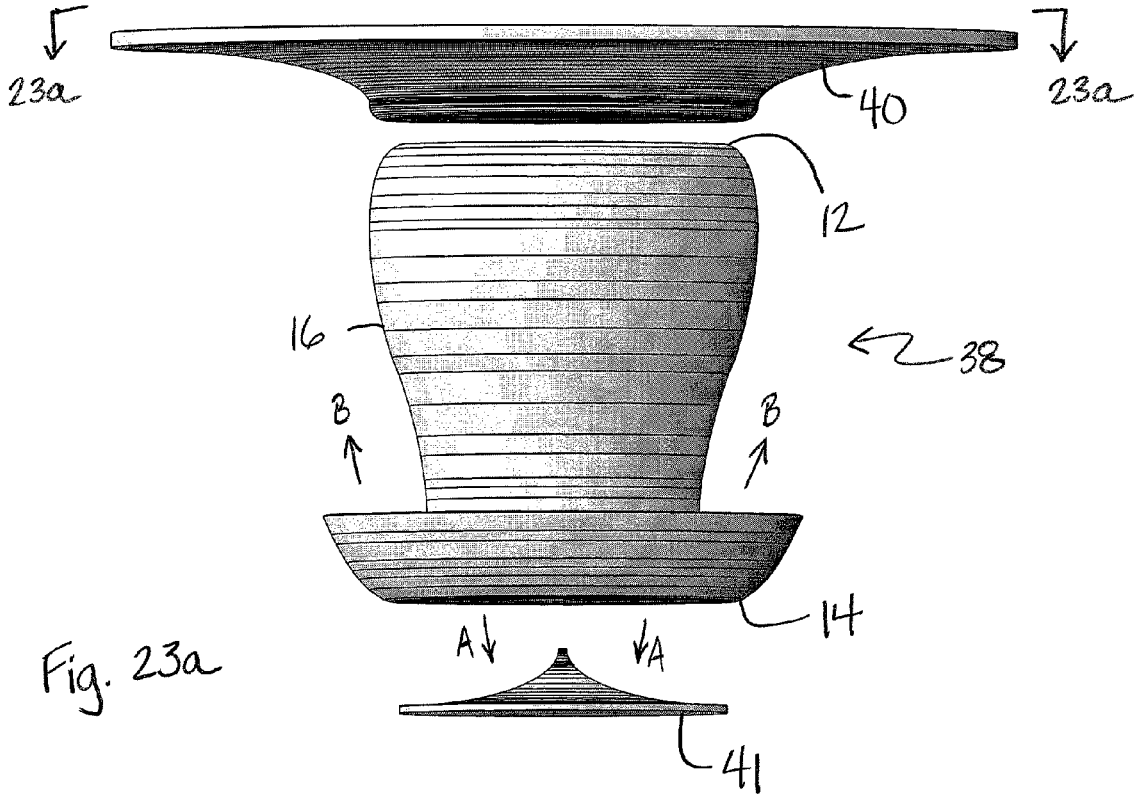
FIG. 23*a* is a side elevational view of the light reflector assembly shown in FIG. 23, the view further illustrating the supplemental reflectors used with the assembly.
Figure 23B:
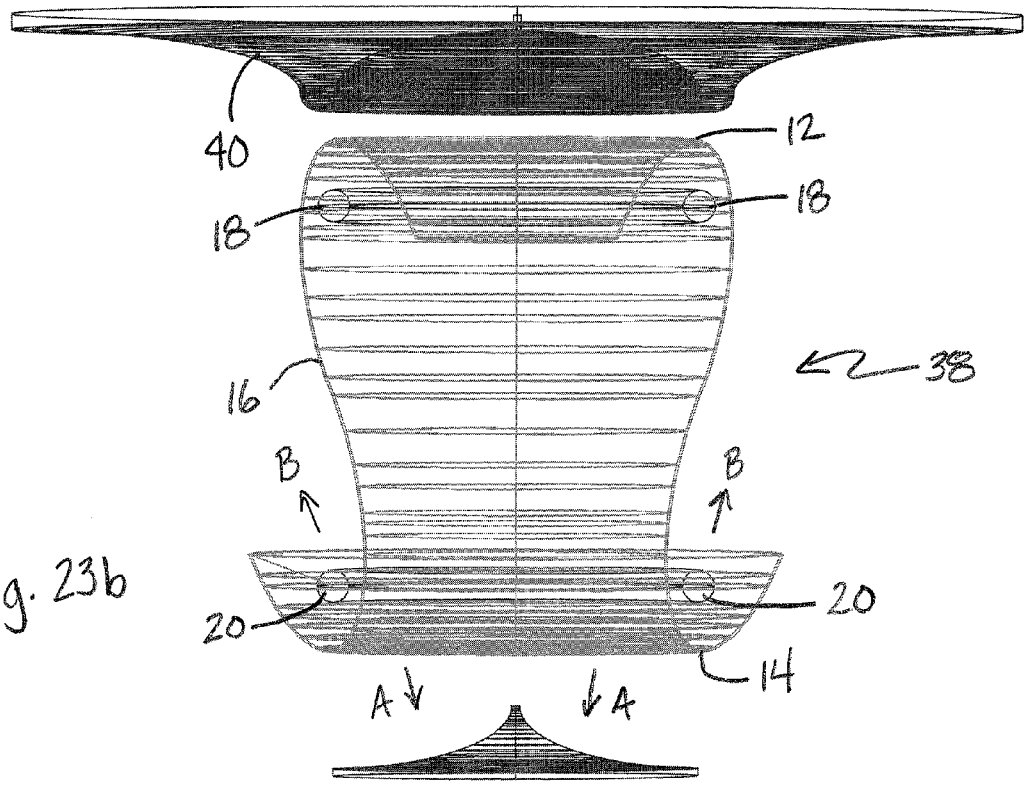
FIG. 23*b* is a side sectional view of the light reflector assembly shown in FIG. 23*a* taken along lines 23*a*-23*a;*
Figure 24:
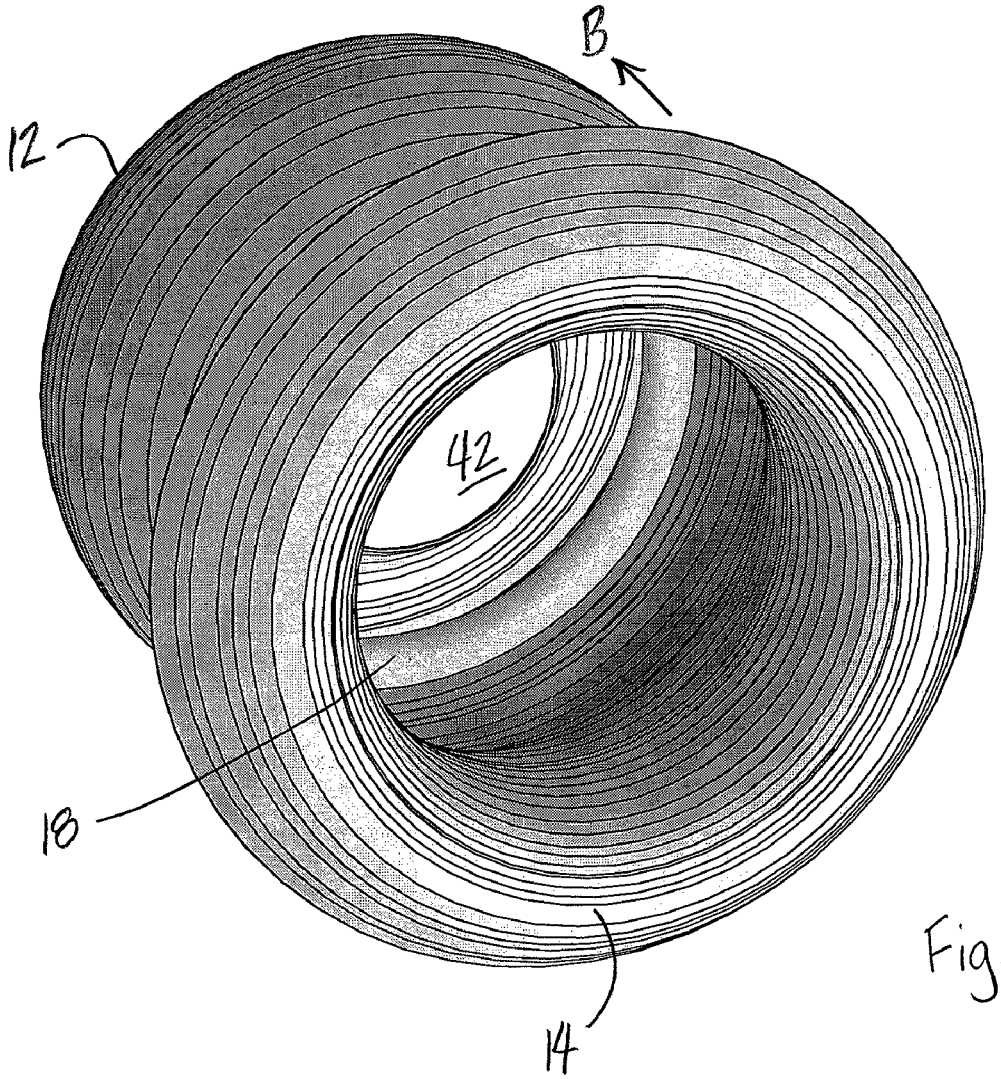
FIG. 24 is a second perspective view of the fifth embodiment of the light reflector assembly illustrated in FIG. 23.
Figure 25:
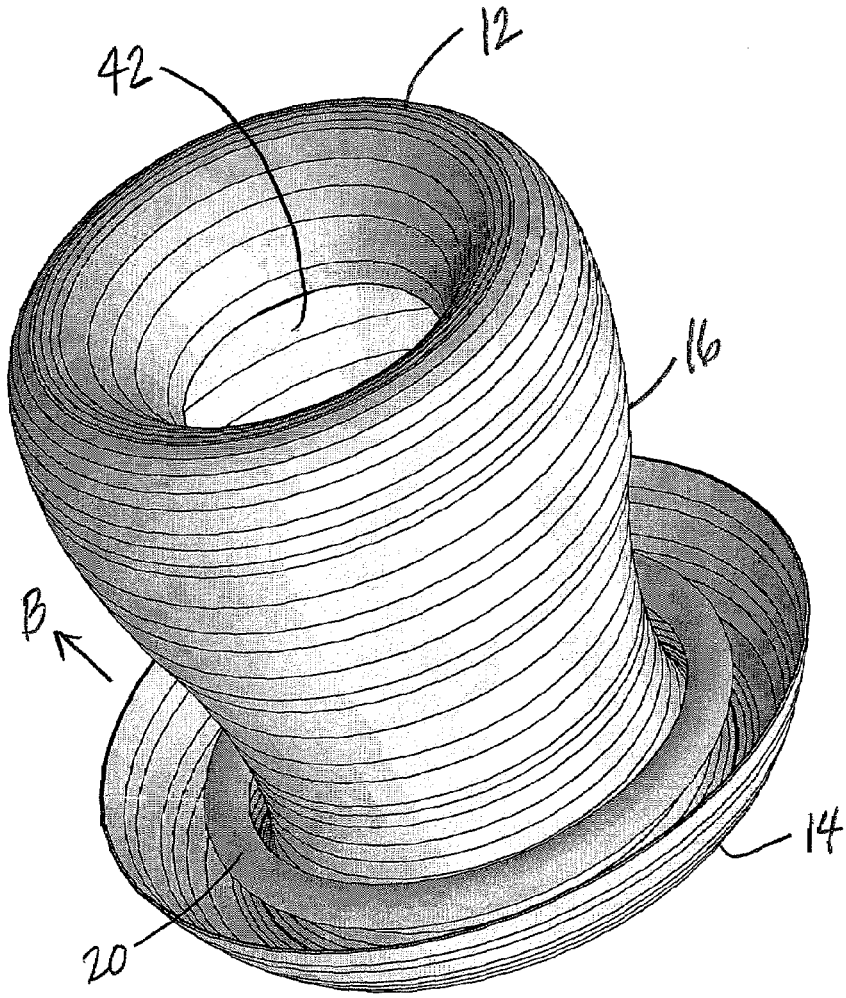
FIG. 25 is a third perspective view of the fifth embodiment of the light reflector assembly illustrated in FIG. 23.
Figure 26:
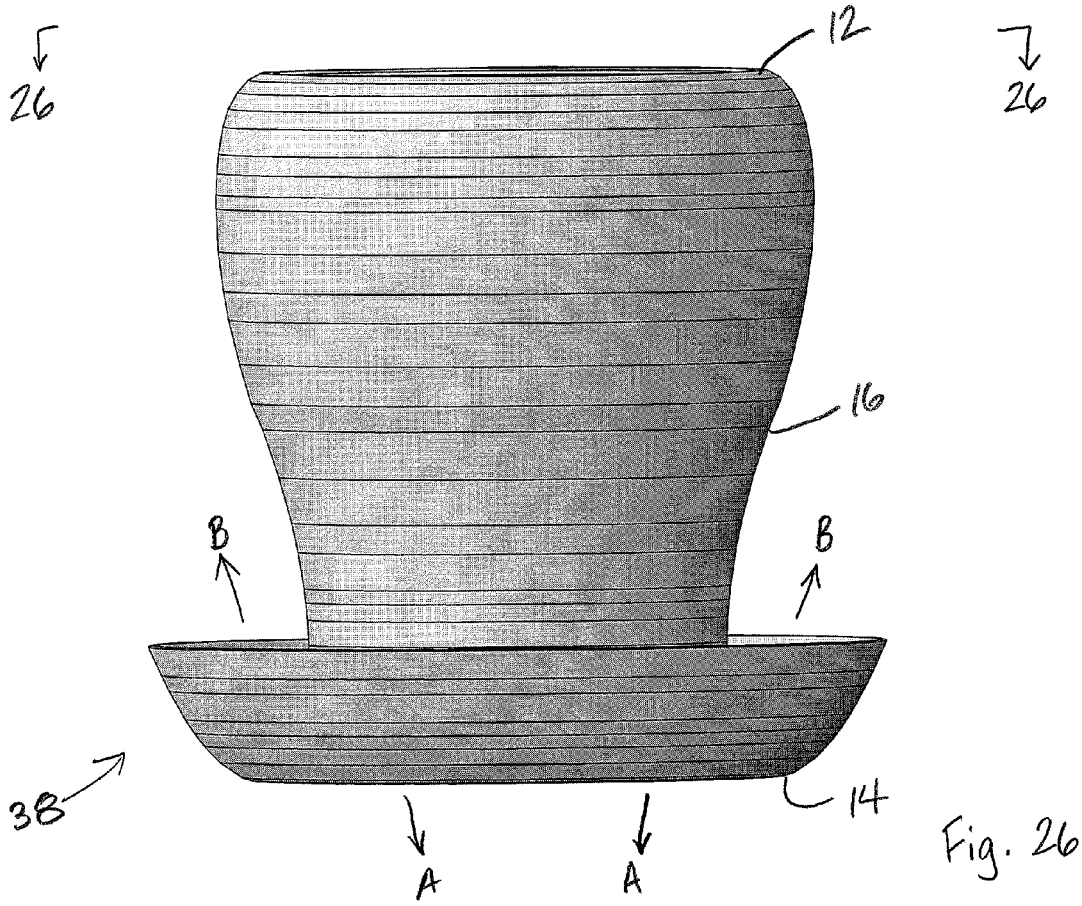
FIG. 26 is a side elevational view of the fifth embodiment of the light reflector assembly illustrated in FIG. 23.
Figure 27:
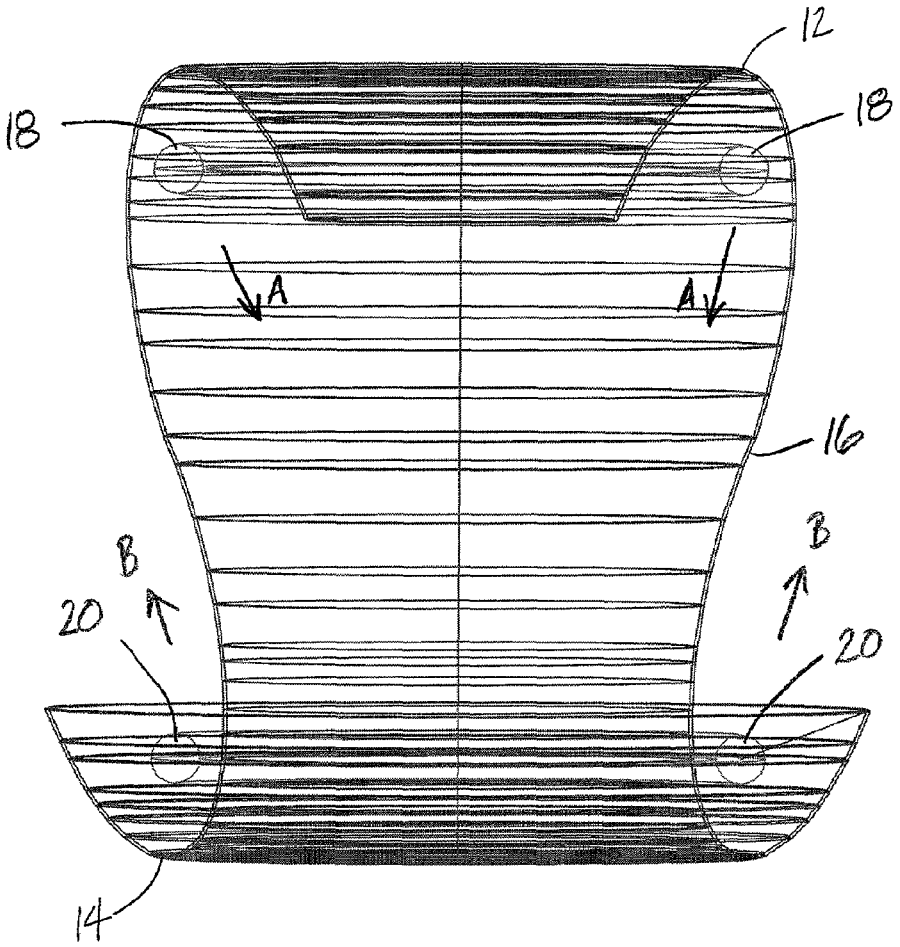
FIG. 27 is a sectional view of the fifth embodiment of the light reflector assembly illustrated in FIG. 26 taken along lines 26-26.

Looking to FIGS. 21 and 22, the linear module 23 may additionally be incorporated with the U-shaped module 34 as desired by the user. In particular, one or more lamps 18, 28 may be included with each module 23, 34 to run the length of the combined modules to provide the direct and indirect lighting as desired by the user.

In a further embodiment shown in FIGS. 23-27, the light reflector 10 may have a circular configuration 38 to be connected to a ceiling mount 40 and secondary reflector 41. In the circular module 38, light is transmitted direction A through the center hole or void 42 of the circular configuration 38 and also in direction B around the perimeter of the light 18, 20. Therefore, depending on the orientation of the module 38, an indirect lighting will extend through the circular module 38 or along the periphery of the circular module 38. Thus, depending on the orientation of the light reflector 10, a pair of circular fluorescent lamps 18, 20 could be used in conjunction with the first section 12 and the lower section 14 of the light reflector 10 to provide either a central direct light within the donut-shaped indirect lighting module 38, or a donut-shaped direct lighting with little indirect lighting. In either case, a ceiling mount 40 could be positioned to correspond with the center section 42 of the reflector 10 to allow connection of the light sources within the centermost section 42 of the reflector 10. The circular module 38 could be connected to ceiling mount 40 along first surface 12, and the light from the second light source 20 traveling in direction B could be reflected by the ceiling mount 40. The secondary reflector 41, which could be connected to either the circular module 38 or the ceiling mount 40 via any number of known connectors or mounting tools, will further reflect or diffuse light from the first light source 18 that is traveling in direction A.

Figure 28:
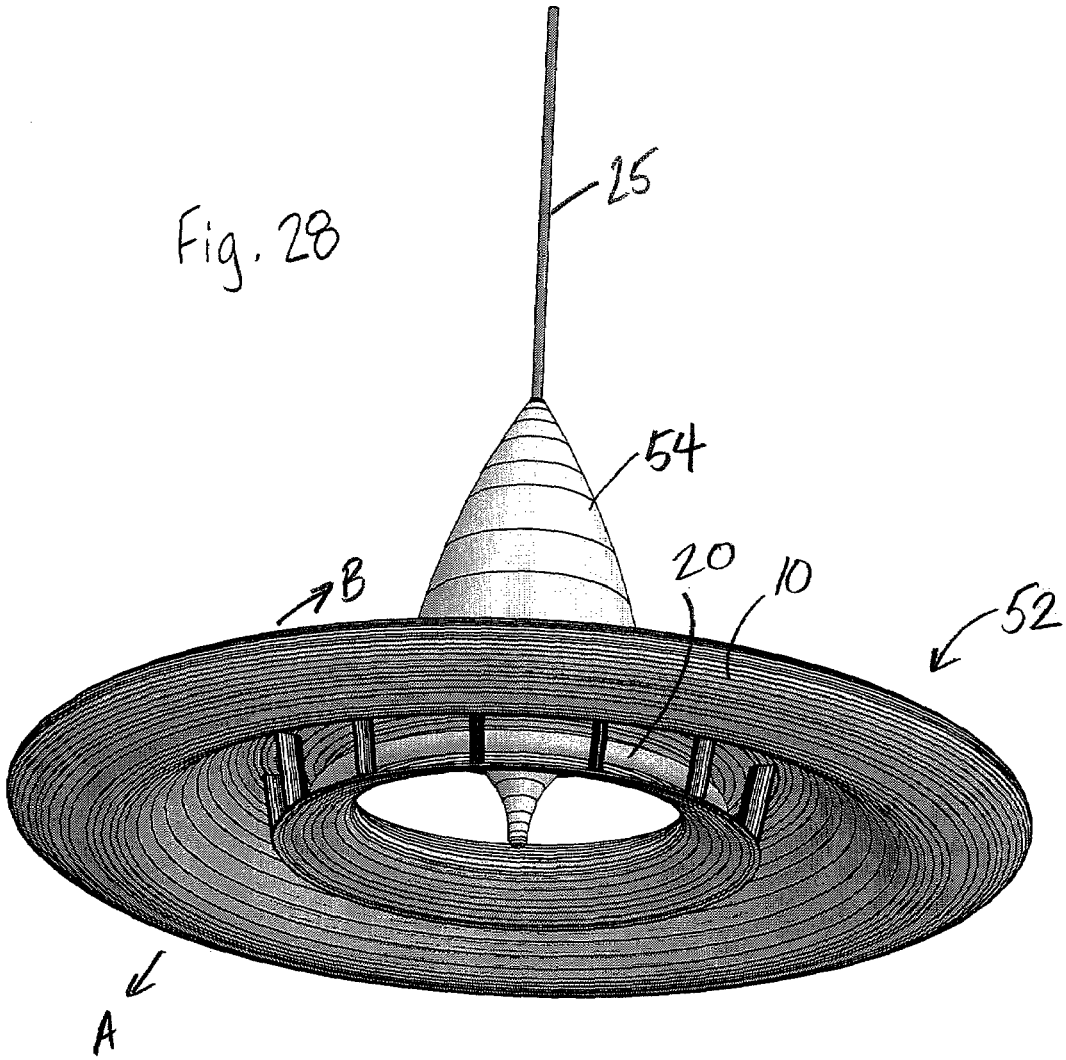
FIG. 28 is a perspective view of a sixth embodiment of the light reflector assembly.
Figure 29:
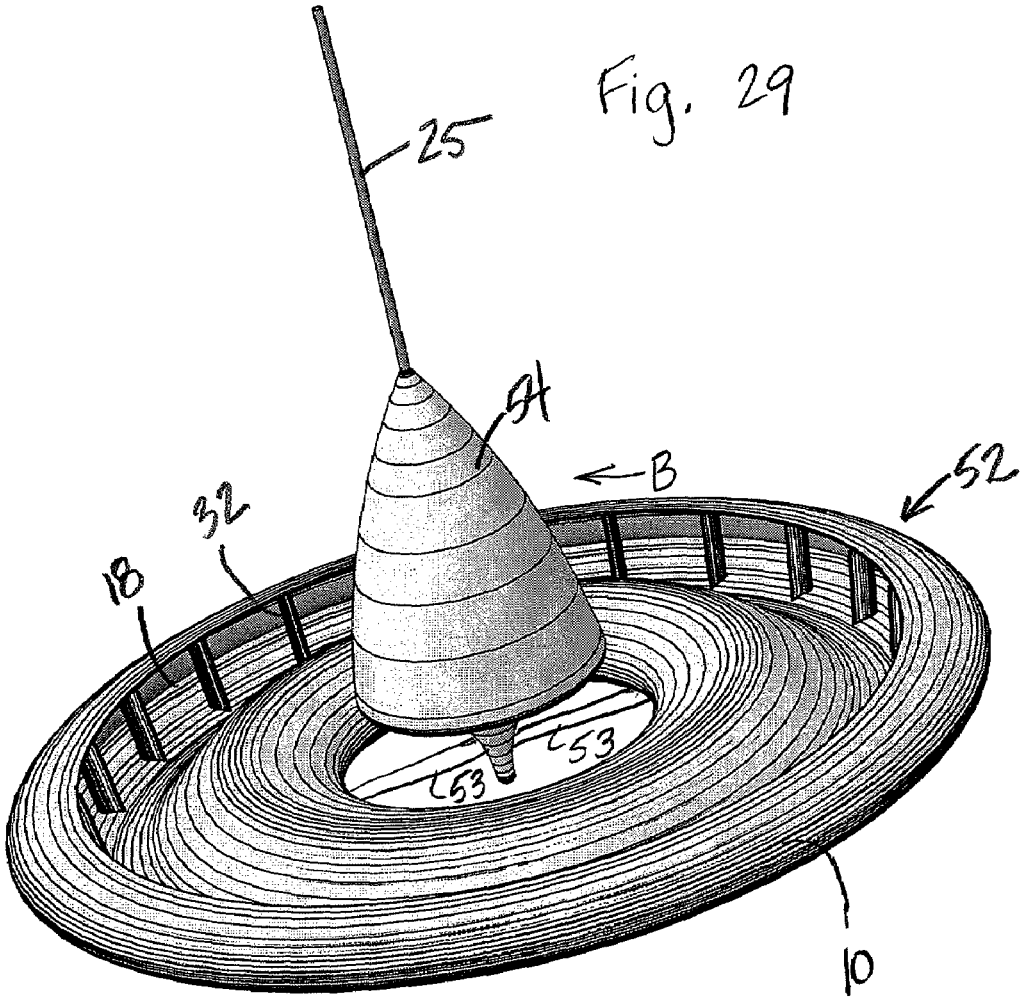
FIG. 29 is second perspective view of the sixth embodiment of the light reflector assembly illustrated in FIG. 28.
Figure 29B:
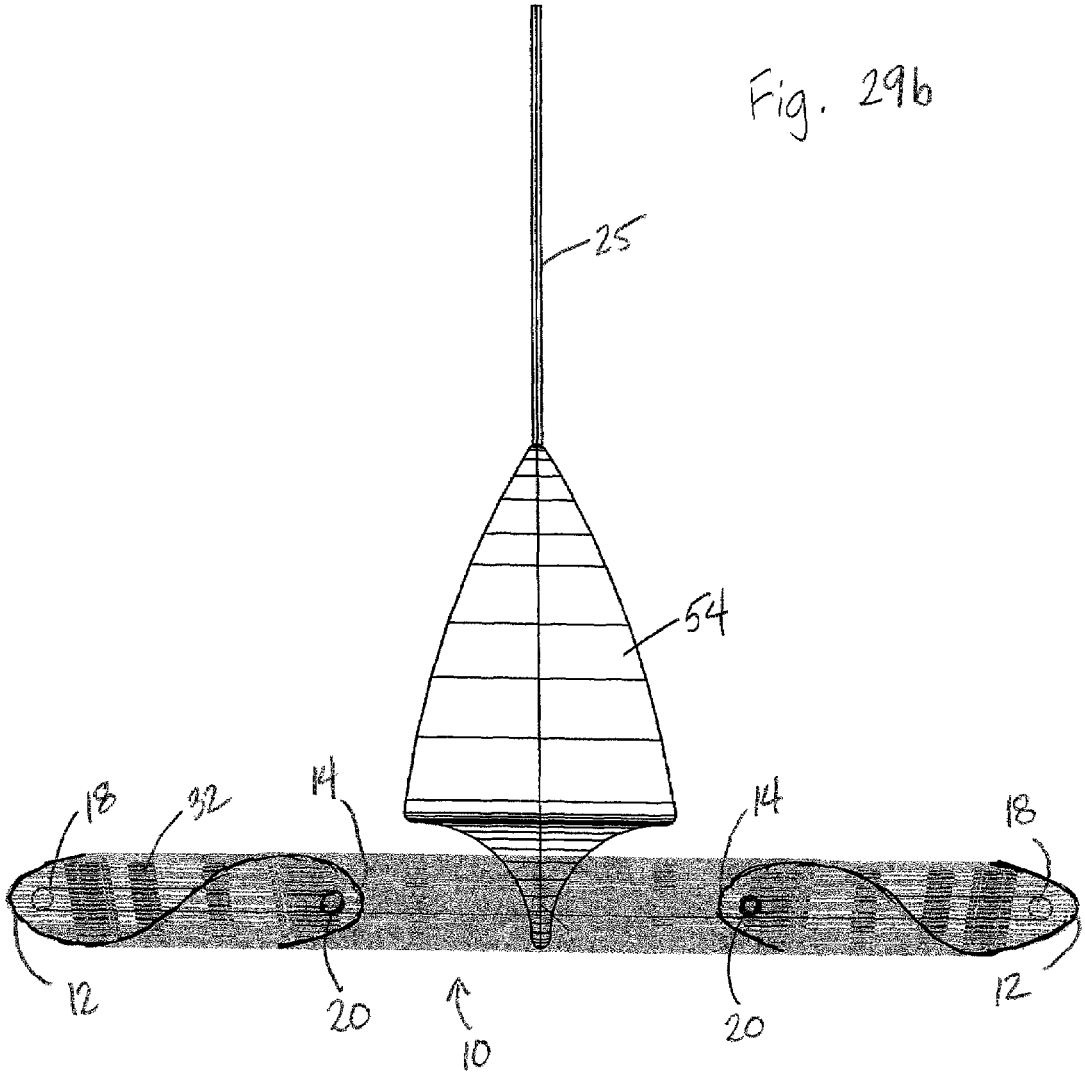
FIG. 29*b* is a sectional view of the sixth embodiment of the light reflector assembly illustrated in FIG. 29.

Referring now to FIGS. 28 and 29, another embodiment of the light reflector 10 is illustrated, wherein the reflector 10 has a horizontal orientation about a predetermined radius to form a substantially donut shape 52, with light being directed inwardly and outwardly. A secondary reflector 54, such as a conical reflector, may be positioned in the center of the light reflector 10, such that the light being directed inwardly will be reflected on the secondary reflector 54 to provide the dispersed light as desired by the user. The secondary reflector 54 may actually be connected to the inner surface of the donut reflector 52 via arms 53 (see FIG. 29), or may it may simply be positioned via another means proximate the donut reflector 52. The arms 53 may house the power feeds for the lamps 18, 20 surrounded by the reflector 52.

Figure 30:
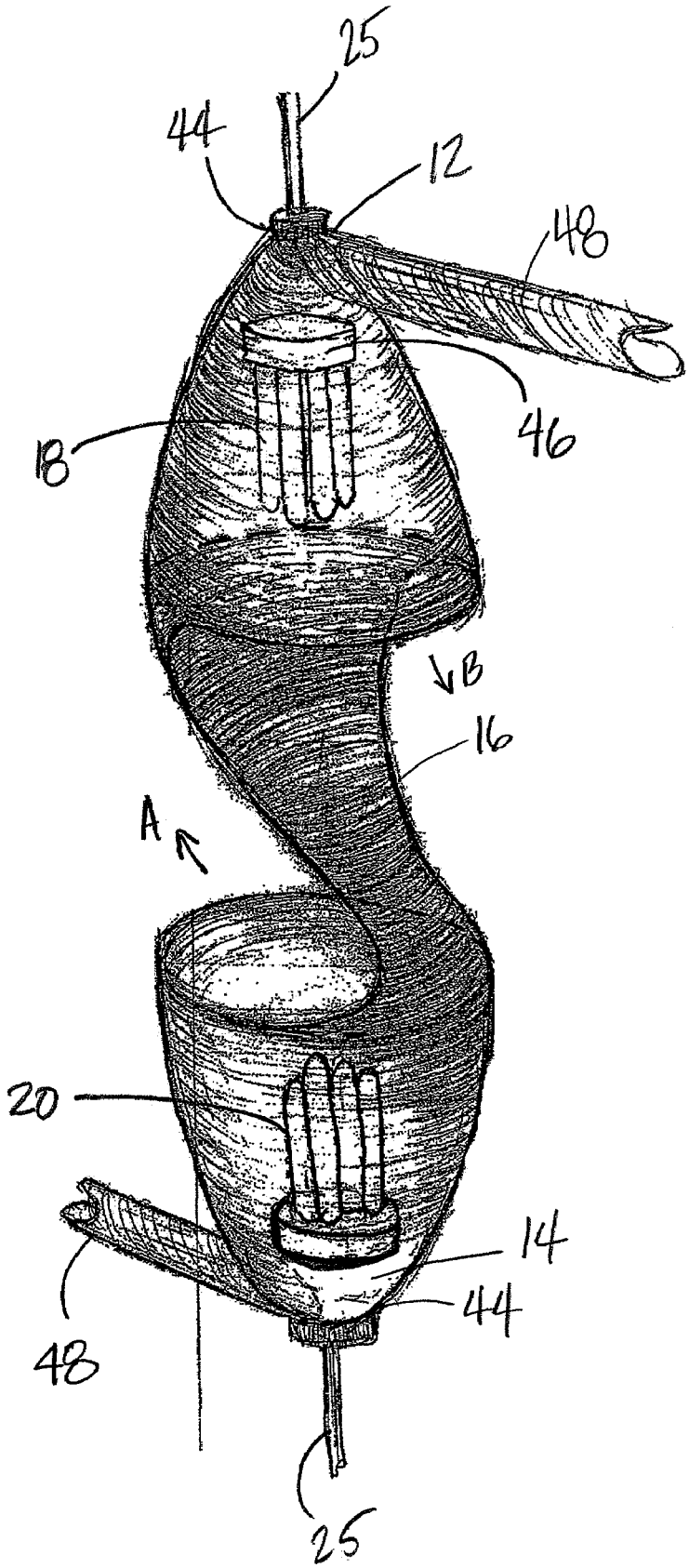
FIG. 30 is a perspective view of a seventh embodiment of the light reflector assembly.

An additional embodiment is shown in FIG. 30. In this provides the light reflector 10 having a first section 12 and a lower section 14 that each taper to a central point 44, respectively, such as a conical design, which can further include sockets 46 suitable to receive a variety of light sources 18, 20, such as incandescent lights, compact fluorescent lights, LED's, metal halide, etc. In this embodiment, the power feed 25 is directed to both the first section 12 of the light reflector 10 and the lower section 14 of the light reflector 10. Furthermore, this embodiment may easily be positioned through the use of a suspension cable 25 or through a mount arm 48. In this embodiment, light is effectively distributed from the first section 12 in direction B to provide direct lighting, from the lower section 14 in direction A to provide indirect lighting, or from both the first section 12 and the lower section 14 to provide a bright environment. As noted above, the user is able to configure this design to be used with multiple types of light sources 18, 20, such as incandescent, halogen, or fluorescent, in view of the conical shape of the first section 12 and the lower section 14.

In addition to the aforementioned module shapes, it is also foreseen that the reflector 10 could be used to create a substantially rectangular module 58 as shown in FIGS. 31*a* and 31*b*. In this embodiment, four linear modules 23 are connected by corner brackets 61, with the corner brackets 61 optionally sharing the same or similar curved configuration as the light reflector 10. In this embodiment, the lamps 18, 20 of each module 23 are connected to each other such that a single switch will control operation of the respective first lamps 18 and second lamps 20.

The rectangular module 58 would be useful in rooms such as a conference rooms or billiard rooms. Specifically, the rectangular module 58 is useful in applications where direct lighting is necessary in a central area 59, but indirect lighting is desired along the periphery of the area. In particular, the orientation of the light reflector 10 can assure that the first section 12 provides direct lighting towards the central area 59, while the lower section 14 provides indirect lighting along the periphery of the rectangular module 58. Further, as illustrated in FIG. 31*b*, the reflector 10 may be positioned at an angle θ pursuant to the desire of the user for dispersion of light in the surrounding area.

Figure 32:
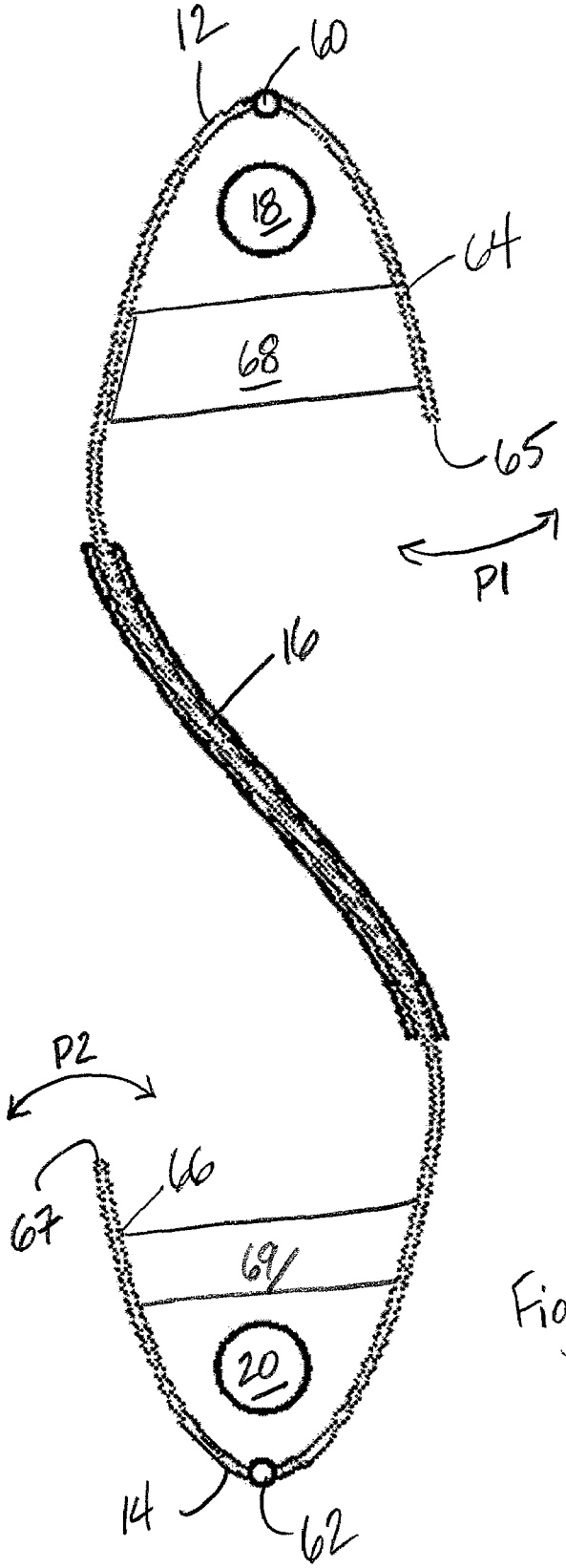
FIG. 32 is a sectional side view of another embodiment of the light reflector assembly having pivotable side edges.

Further embodiments of the light reflector 10 include improvements to allow controlled lighting by the user as desired. In one embodiment, either the first section 12 or the second section 14, or both, may include pivotable connectors 60, 62 dividing the first section 12 and/or the lower section 14 into separate components, respectively, about the pivot points 60, 62, as shown in FIG. 32. The pivotable connectors 60, 62 therefore will define side elements or arms 64, 66 of the respective sections 12, 14 that may be rotated about the pivot point 60, 62 in the directions P1, P2 respectively. That is, the free ends 65, 67 opposite the pivot points 60, 62 will move to determine the illumination provided by the light in either the first section 12 or the lower section 14 of the light reflector 10. That is, the closer that the free ends 65, 67 of the side elements 64, 66 are to the central section 16 of the light reflector 10, the less light that is dispersed into the surrounding area. On the other hand, the further the free ends 65, 67 of the side elements 64, 66 are from the light reflector 10, the more light that is dispersed into the surrounding area. This embodiment therefore provides for dimming of the lights 18, 20 without requiring a dimmer switch electrically connected to the lights 18, 20.

It is further foreseen that a parabolic baffle 68 may be connected between the free end 65 of the first side element 64 of the first section 12 and the connecting section 16, and a second parabolic baffle 69 may be connected between the free end 67 of the second side element 66 of the lower section 14 and the connecting section 16. The parabolic baffles 68, 69 will help to control the desired intensity of the light provided of the light sources 18, 20.

Figure 33:
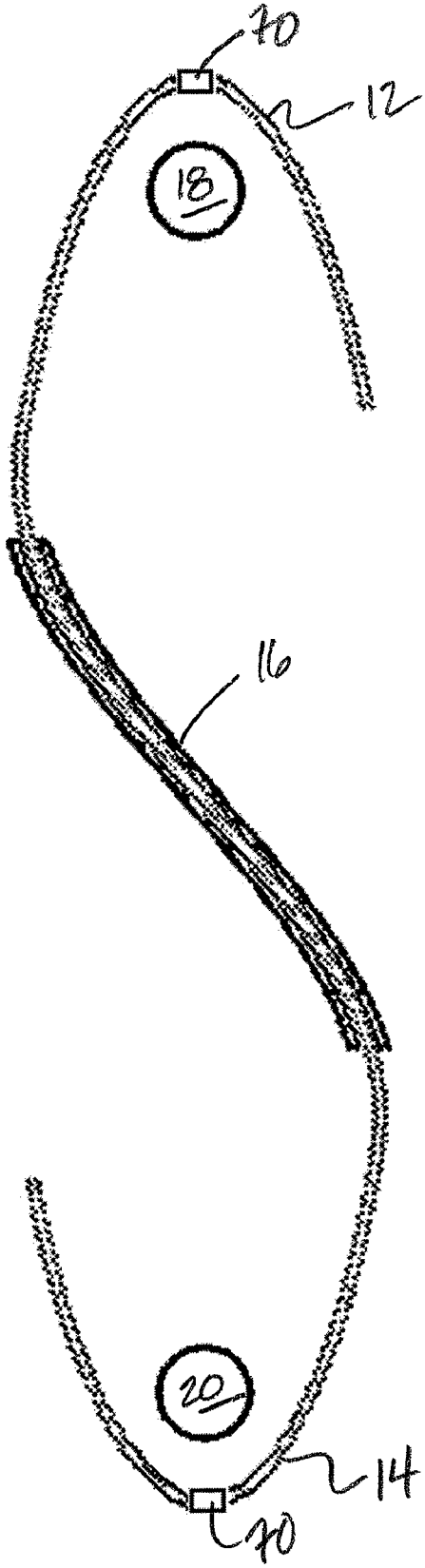
FIG. 33 is a sectional side view of a further embodiment of the light reflector assembly having end diffusers.

In another embodiment shown in FIG. 33, rather than having pivotable connecting points 60, 62 as shown in FIG. 32, the light reflector 10 could include a tiny prismatic diffuser 70 along the top of the first section 12 or along the bottom of the lower section 14. The diffuser 70 provides another medium and corresponding direction for scattering light from the lamps 18, 20 through the light reflector 10 in yet another direction to attract the attention of a persons nearby.

Figure 34A:
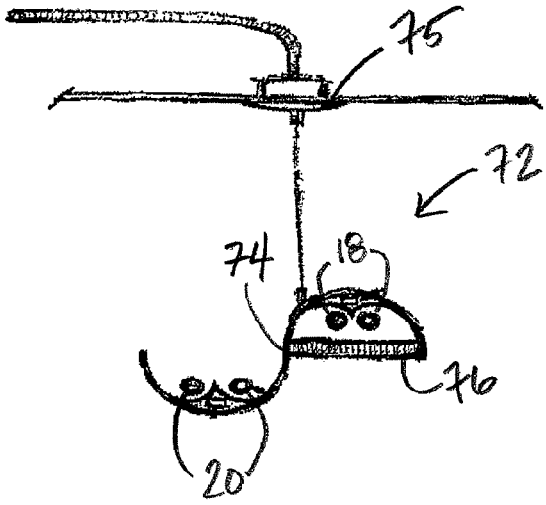
FIGS. 34*a*-34*c* are sectional views of another embodiment of the light reflector assembly.
Figure 34B:
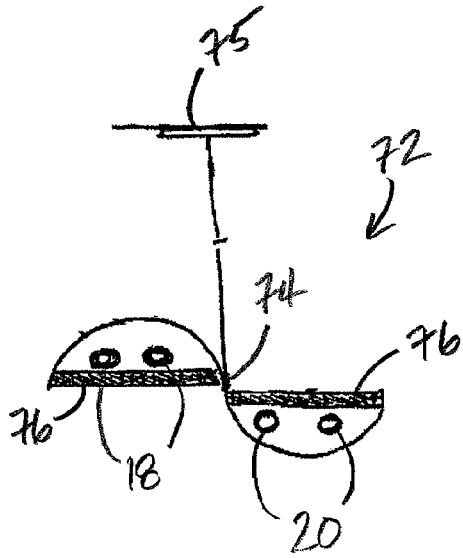
Figure 34C:
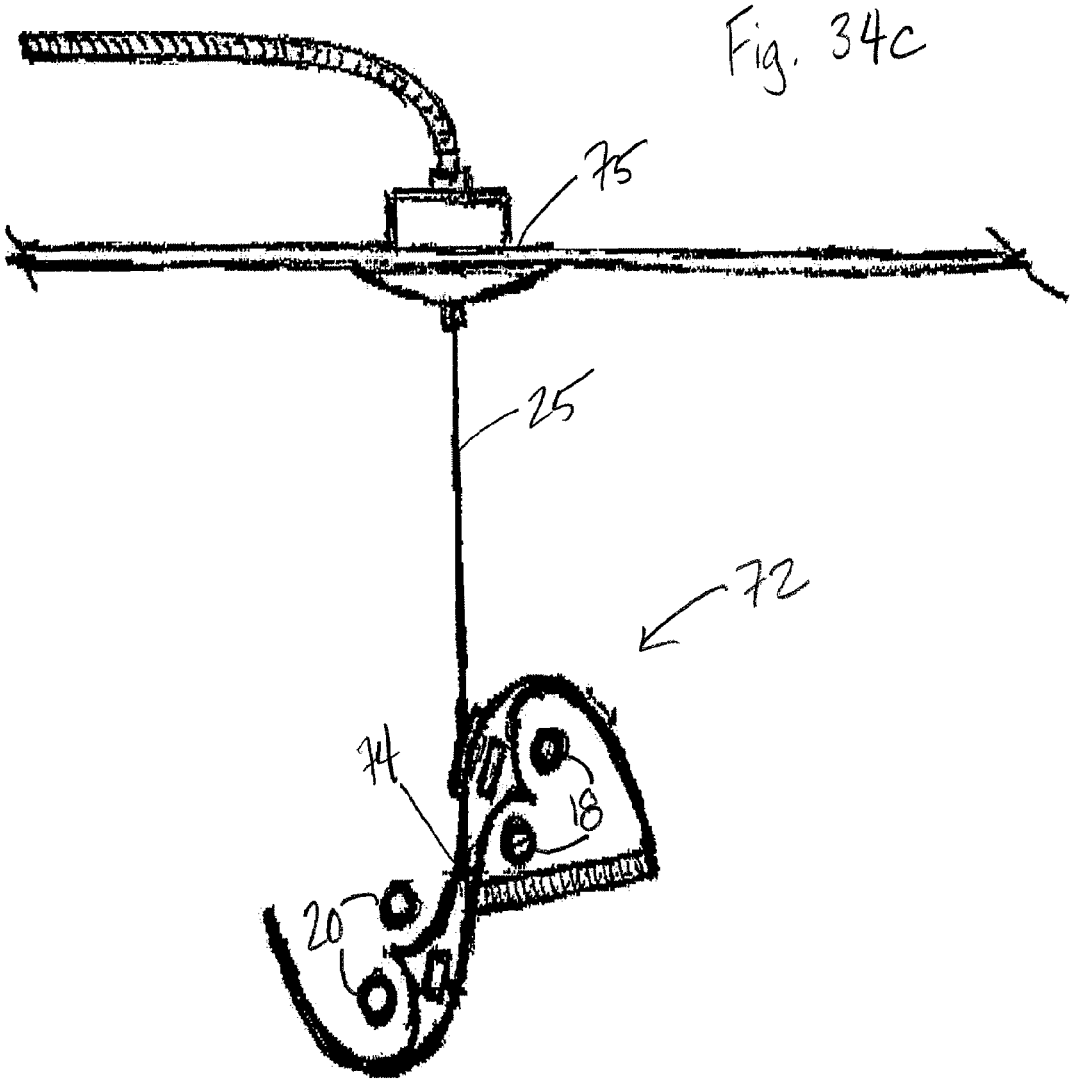
Figure 35A:
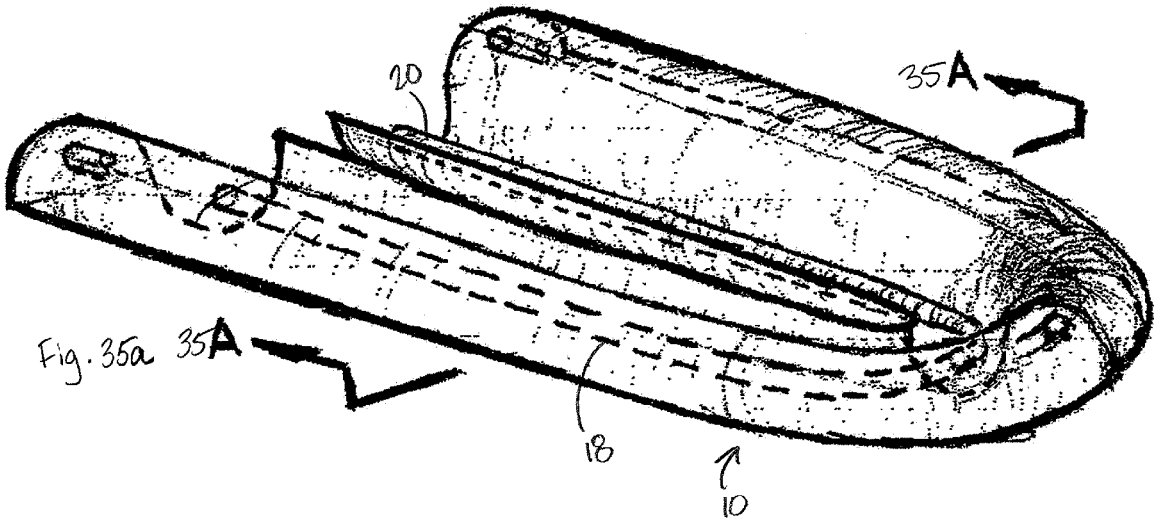
FIGS. 35*a*-35*b* are views of a U-shaped light reflector assembly corresponding to the linear module illustrated in FIG. 34*a;*
Figure 35B:
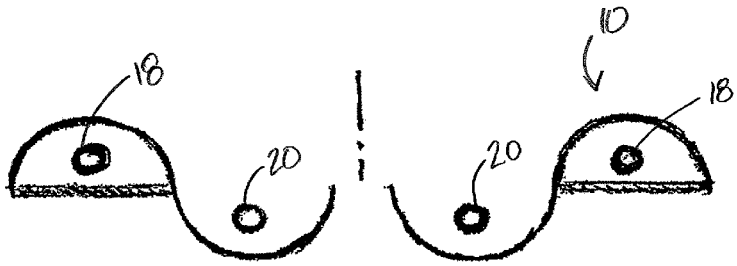
Figure 36:
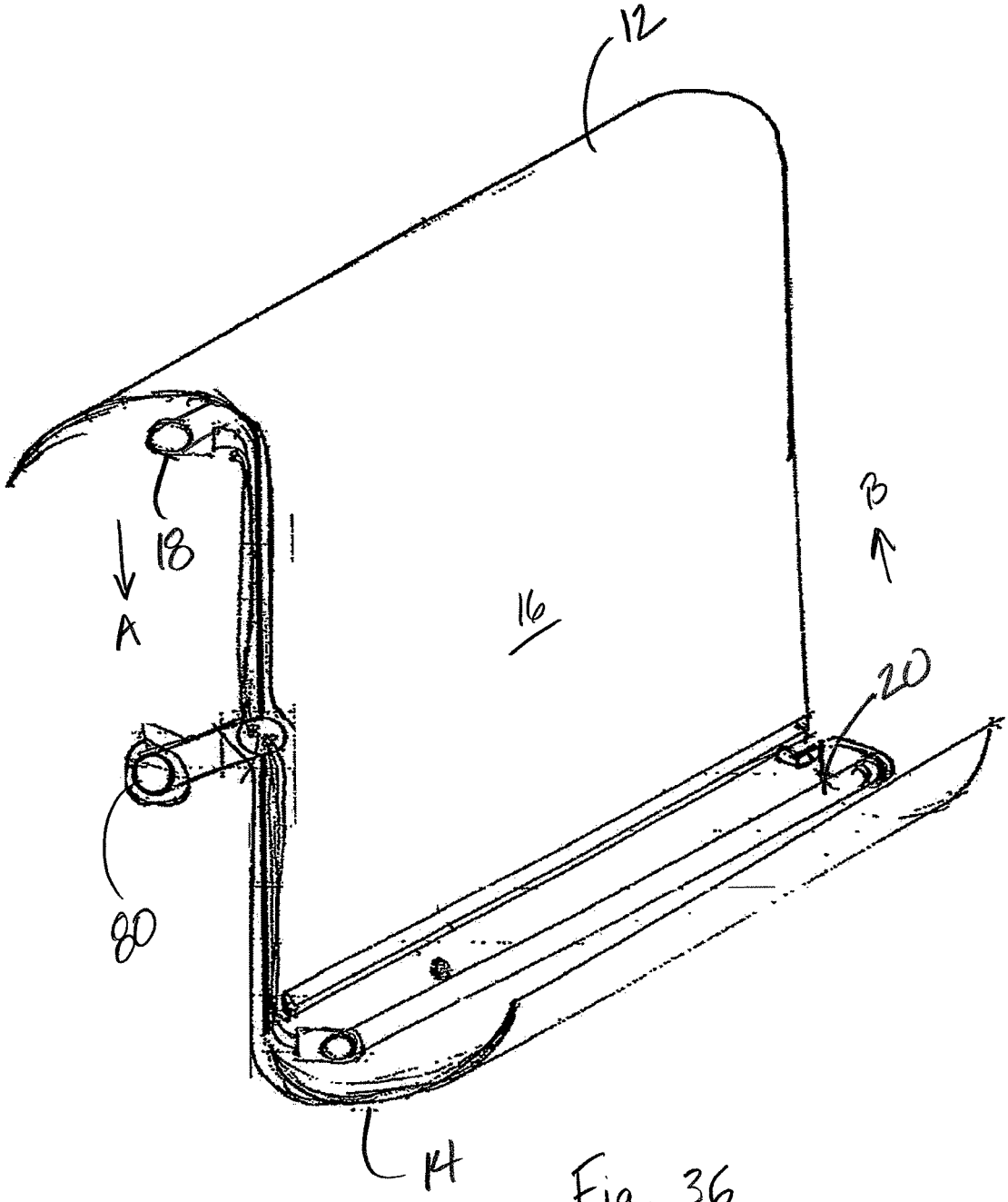
FIG. 36 is perspective view of a light reflector assembly pivotable about a central connector.

In another embodiment illustrated in FIGS. 34*a*-34*c*, a four-lamp inverted semi-circular reflector 72 is connected at the center 74. As illustrated, the circular reflector 72 includes two semicircular reflectors 70 that are connected at a central point 74, with each reflector 10 housing at least one lamp 18, 20. A cable suspension 25 can further be connected to the reflectors 10 at various locations, such as at the midpoint of the two reflectors 10, (FIG. 34*a*) or at an asymectrical location if necessary for fixture balance (FIG. 34*b*), such that the assembly 72 can be hung from an first surface. In addition, a parabolic diffuser 76 may be attached to the open section of one reflector 10 or both reflectors 10 if desired by the user. Furthermore, this design illustrates that the reflectors 10 may be hung in a substantially horizontal position, such that the output of one lamp 18 is directed upward to provide indirect lighting while the output of the other lamp 20 is directed directly downward. In addition, the embodiment shown in FIG. 34*c* illustrates that the lamp may have an angular orientation. It should be noted that the embodiment illustrated in FIG. 34*a* could also be U-shaped orientation 78 using the 2 U-lamp sizes as presently manufactured as illustrated in FIGS. 35*a* and 35*b*. In addition, looking to FIG. 36, the light reflector 10 may be mounted on a pivot pin 80, such that the light reflector 10 may be rotated about the pivot pin 80 to adjust the directions A, B of light provided by the lamps 18, 20, and consequently light levels in the surrounding area.

Figure 37:
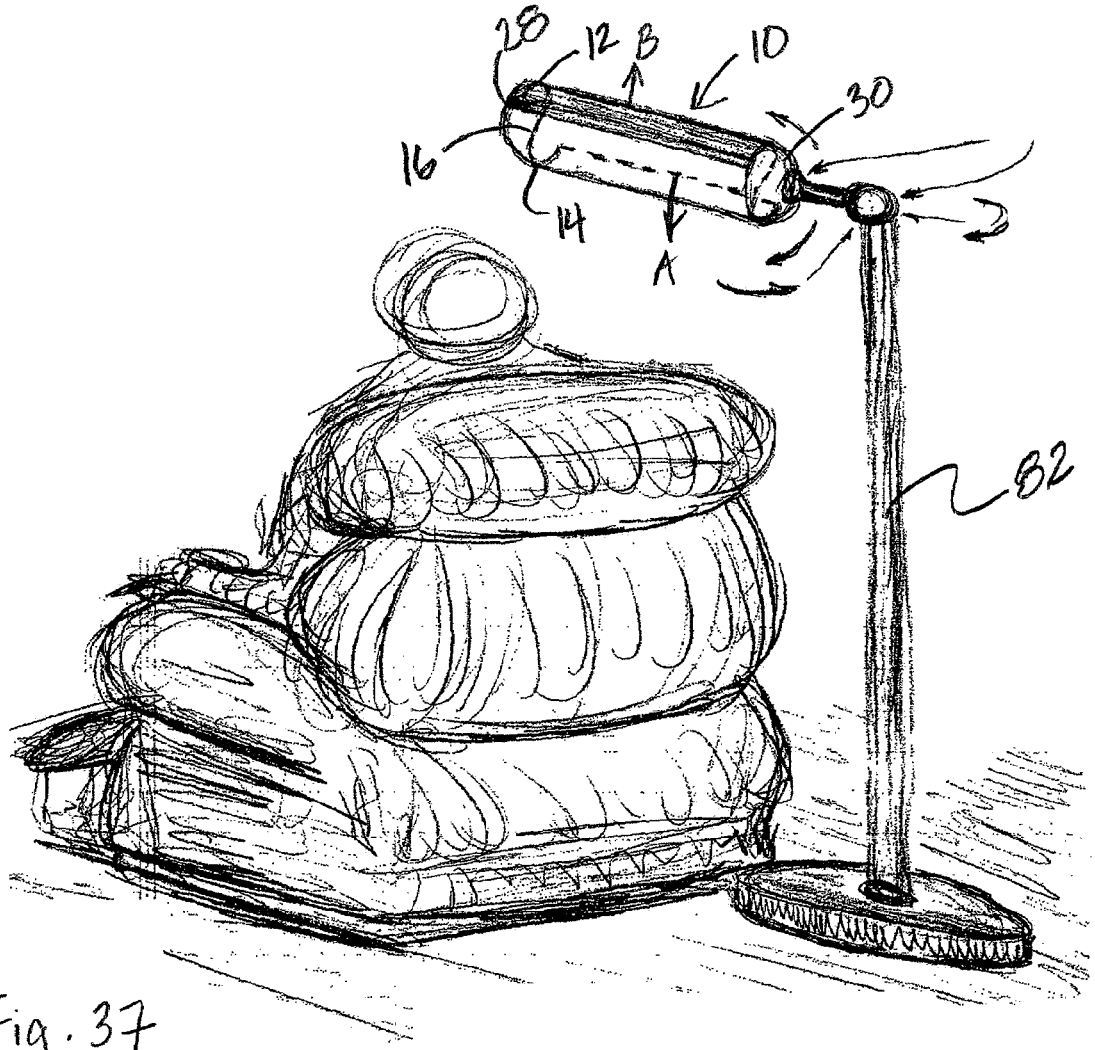
FIG. 37 is a perspective view of a lamp incorporating the light reflector assembly illustrated in FIGS. 3-6.

Looking further to FIG. 37, it is additionally foreseen that a reflector 10 having a simple linear module 23 design can be incorporated into a personal lamp. That is, the end cap 30 of the linear module 23 may be connected to a stand 82 such that the module 23 is easily rotated in a variety of directions. In this embodiment, light will be directed in direction A toward the user, but will also have an ambient light provided in direction B.

The attached figures illustrate the basic concept for the present invention. These sketches, pictures, and drawings show only a sampling of the embodiments for a section of the applications for the invention as described in the present application. The reflector 10 may be used in a broad area of applications utilizing the illuminating power of multiple types of light sources. These light sources include (but are not limited to) fluorescent, high intensity discharge, incandescent, light emitting diode, tungsten halogen, cold cathode, neon, etc. The applications that can benefit from this invention include (but are not limited to):

Safety (1) Exit signage;

(2) Exit stair illumination;

(3) Directional and way-finding signage for schools, arenas, etc.;

Efficiency and Improved Visual Acuity (4) Conference room illumination;

(5) Video conference illumination;

(6) General direct and indirect illumination for open office environments;

(7) Residential and commercial kitchen illumination (circline and "U" lamp configurations);

(8) Acoustical sound attenuation for all applications;

(9) Incorporation into modular furniture systems for individual task lighting;

(10) Incorporation into architectural wall systems;

(11) Exterior/Interior architectural design element illumination;

(12) Exterior/Interior advertising and signage illumination);

(13) Interior aircraft illumination; and

(14) Hospitality environment illumination (for example, the circline configuration, pendant mounted over each table in a restaurant).

The aforementioned applications are illustrative of a section of various embodiments using this reflector 10. These benefits include, (but are not limited to), improved life safety, energy savings, improved visual acuity, etc. As this technology advances, other applications may come into play, (including, but not limited to), medical, theatrical, and others.

Having thus described exemplary embodiments of the present invention, it should be noted by those skilled in the art that the within disclosures are exemplary only and that vari-ous other alternatives, adaptations, and modifications may be made within the scope of the present invention. Accordingly, the present invention is not limited to the specific embodiments as illustrated herein, but is only limited by the following claims.

What is claimed is:

1. A light reflector assembly comprising:

first and second light sources;

a light reflector for selectively reflecting light from the pair of light sources including a first section near the first light source to reflect light from the first light source in a first direction, said first section comprising a pivot connector defining a first side arm, said first side arm pivotable about said pivot connector to control the light distributed from the first light source;

a second section inverted with respect to said first section, said second section positioned near the second light source to reflect light from the second light source in a second direction that is substantially contrary to the first direction; and securing means for connecting said first section in relation to said second section so that direction of the light reflected from the first section is substantially opposite to the direction of the light from the second section.

2. The assembly as described in claim 1, wherein said securing means comprises a central connector joining said first section with said second section in a single substantially S-shaped reflector.

3. The assembly as described in claim 1 wherein said securing means comprises a central section configured for joining said first section and said second section to form a U-shaped reflector.

4. The assembly as described in claim 1, wherein said first and second sections are substantially conical; said first and second sections joined by a central connector.

5. The assembly as described in claim 1, wherein said securing means comprises an end cap, said first section and said second section independently connected to said end cap.

6. The assembly as described in claim 1, comprising:

a first end cap; and a second end cap;

said first section having a proximal end engaging said first end cap and a distal end engaging said second end cap, and said second section having a proximal end engaging said first end cap and a distal end engaging said second end cap.

7. The assembly as described in claim 1 comprising a diffuser integrated into said first section.

8. The assembly as described in claim 1 comprising:

a power source; and at least one ballast connected between the light sources and said power source.

9. The assembly as described in claim 1 comprising:

a series of parabolic reflectors mounted in said first section and said second section.

10. The assembly as described in claim 1 wherein said first section and said second sections are substantially curved shapes.

11. The assembly as described in claim 1, wherein said central connector is substantially translucent.

12. The assembly as described in claim 11, further comprising a symbol proximate said translucent central connector.

13. A light reflector assembly comprising:

first and second light sources;

a light reflector for selectively reflecting light from the pair of light sources, the light reflector including a first section near the first light source to reflect light from the first light source in a general first direction;

a second section inverted with respect to said first section, said second section positioned near the second light source to reflect light from the second light source in a general second direction substantially opposite to said first direction; and securing means for connecting said first section in relation to said second section so that the direction of the light reflected from the first section is substantially opposite to the direction of the light from the second section;

wherein said securing means comprises a central section configured for joining said first section and said second section to form a circular reflector surrounding a center void.

14. The assembly as described in claim 13, further comprising a ceiling mount to support said first section, said second section and said central section.

15. The assembly as described in claim 13 further comprising a central reflector positioned in said center void.

16. The assembly as described in claim 15, further comprising at least one arm connecting said first section with said central reflector.

17. A light reflector assembly comprising:

first and second light sources;

a light reflector for selectively reflecting light from the pair of light sources, the light reflector including a first section near the first light source to reflect light from the first light source in a general first direction, said first section including a pivot connector defining a first side arm, said first side arm pivotable about said pivot connector to control the light distributed from the first light source;

a second section inverted with respect to said first section, said second section positioned near the second light source to reflect light from the second light source in a general second direction substantially opposite to said first direction; and a connector section linking said first section in relation to said second section.

18. The light reflector assembly as described in claim 17 wherein said first section, said second section and said connector form a unitary substantially S-shaped reflector.

19. The light reflector assembly as described in claim 17 further comprising:

at least one parabolic reflector connected to said first section; and at least one parabolic reflector connected to said second section.

* * * * *